US010145554B2

(12) United States Patent
Bears

(10) Patent No.: US 10,145,554 B2
(45) Date of Patent: Dec. 4, 2018

(54) SCALEABLE SOLID STATE LIGHTING APPARATUS

(71) Applicant: Bears Green Engineering LLC, Boynton Beach, FL (US)

(72) Inventor: James Bears, Boynton Beach, FL (US)

(73) Assignee: LUMENEX SOLERGIA SPA, Santiago, RM (CL)

( * ) Notice: Subject to any disclaimer, the term of this patent is extended or adjusted under 35 U.S.C. 154(b) by 200 days.

(21) Appl. No.: 15/007,854

(22) Filed: Jan. 27, 2016

(65) Prior Publication Data

US 2016/0320049 A1 Nov. 3, 2016

Related U.S. Application Data

(60) Provisional application No. 62/108,191, filed on Jan. 27, 2015.

(51) Int. Cl.

| | |
|---|---|
| ***F21S 9/00*** | (2006.01) |
| ***F21V 31/00*** | (2006.01) |
| ***F21V 29/76*** | (2015.01) |
| ***F21V 15/01*** | (2006.01) |
| ***F21V 29/83*** | (2015.01) |
| ***F21S 9/02*** | (2006.01) |
| ***F21V 17/10*** | (2006.01) |
| ***F21V 23/00*** | (2015.01) |

(Continued)

(52) U.S. Cl.

CPC ..... *F21V 31/005* (2013.01); *F21S 9/02* (2013.01); *F21V 15/013* (2013.01); *F21V 17/107* (2013.01); *F21V 23/005* (2013.01); *F21V 23/006* (2013.01); *F21V 29/76* (2015.01); *F21V 29/83* (2015.01); *F21S 9/024* (2013.01); *F21W 2131/103* (2013.01); *F21Y 2105/10* (2016.08); *F21Y 2113/00* (2013.01); *F21Y 2115/10* (2016.08)

(58) Field of Classification Search

None

See application file for complete search history.

(56) References Cited

U.S. PATENT DOCUMENTS 7,789,528 B2 9/2010 Mo et al.
8,061,869 B2 11/2011 Lo (Continued)

FOREIGN PATENT DOCUMENTS

CN 204387912 U 6/2015

OTHER PUBLICATIONS

IPRP for PCT/US2016/015107, dated Aug. 1, 2017.

*Primary Examiner* — Britt D Hanley

(74) *Attorney, Agent, or Firm* — Dinsmore & Shohl LLP

(57) ABSTRACT

A lighting apparatus includes a front enclosure and a back enclosure including guide slots formed thereon. A mounting plate including a plurality of LEDs mounted thereon is attached to the back enclosure. A circuit board is attached to the mounting plate. A center extrusion is attached to the back enclosure. A plurality of spaced fin extrusions are attached to the mounting plate and positioned in the guide slots of the back enclosure. Side rails are attached to the mounting plate and back enclosure and spaced from the fin extrusions. The plurality of spaced fin extrusions and side rails allow passage of air in an upward direction between the spaced extrusions and side rails transferring heat generated from the lighting apparatus to the air.

19 Claims, 33 Drawing Sheets

(51) Int. Cl.

| | |
|---|---|
| *F21W 131/103* | (2006.01) |
| *F21Y 113/00* | (2016.01) |
| *F21Y 105/10* | (2016.01) |
| *F21Y 115/10* | (2016.01) |

(56) References Cited

U.S. PATENT DOCUMENTS

| | | | | |
|---|---|---|---|---|
| 8,220,960 | B2 | 7/2012 | Long et al. | |
| 2006/0250803 | A1 * | 11/2006 | Chen ..... | F21S 8/086<br>362/373 |
| 2010/0254140 | A1 | 10/2010 | Wen et al. | |
| 2012/0087118 | A1 | 4/2012 | Bailey et al. | |

* cited by examiner

SCALEABLE SOLID STATE LIGHTING APPARATUS

CROSS-REFERENCE TO RELATED APPLICATIONS

This application claims priority of U.S. Provisional Patent Application Ser. No. 62/108,191 filed Jan. 27, 2015, which is incorporated herein by reference.

FIELD OF THE INVENTION

The invention relates to a LED lighting apparatus.

BACKGROUND OF THE INVENTION

Lighting apparatus may include LED assemblies for generating a light output. These LEDS systems need to regulate a temperature to prevent overheating and damage to the assemblies. Complicated heat sink structures may be used in the prior art. There is therefore a need in the art for a light structure that allows dissipation of heat using the air.

Further, there is a need in the art for a light assembly that may be easily scaled and adjusted for various sizes to allow secure sealing of all of the electronic components against water and the environment. There is also a need in the art for a lighting assembly that is easy to assemble when it is scaled from one size to another.

SUMMARY OF THE INVENTION

In one aspect, there is disclosed a lighting apparatus that includes a front enclosure and a back enclosure including guide slots formed thereon. A mounting plate including a plurality of LEDs mounted thereon is attached to the back enclosure. A circuit board is attached to the mounting plate. A center extrusion is attached to the back enclosure and also to the led holding mounting plate. A plurality of spaced fin extrusions are attached to the mounting plate and positioned in the guide slots of the back enclosure. Side rails are attached to the mounting plate and back enclosure and spaced from the fin extrusions. The plurality of spaced fin extrusions and side rails allow passage of air in an upward direction between the spaced extrusions and side rails transferring heat generated from the lighting apparatus to the air.

In another aspect, there is disclosed a lighting apparatus including a front enclosure and a back enclosure. A mounting plate including a plurality of LEDs mounted thereon includes a circuit board attached to the mounting plate. A plurality of spaced fin extrusions are attached to the mounting plate. The plurality of spaced fin extrusions allow passage of air in an upward direction between the spaced fin extrusions transferring heat generated from the lighting apparatus to the air.

In a further aspect there is disclosed a lighting apparatus including a front enclosure and a back enclosure. A mounting plate includes a plurality of LEDs mounted thereon and the mounting plate includes a plurality of nuts formed thereon. A circuit board is attached to the mounting plate. A plurality of spaced extrusions are attached to the mounting plate, the extrusions including T shaped slots formed thereon slidingly receiving the plurality of nuts of the mounting plate. The plurality of spaced extrusions allow passage of air in an upward direction between the spaced extrusions transferring heat generated from the lighting apparatus to the air.

DETAILED DESCRIPTION OF THE PREFERRED EMBODIMENTS

Figure 1:
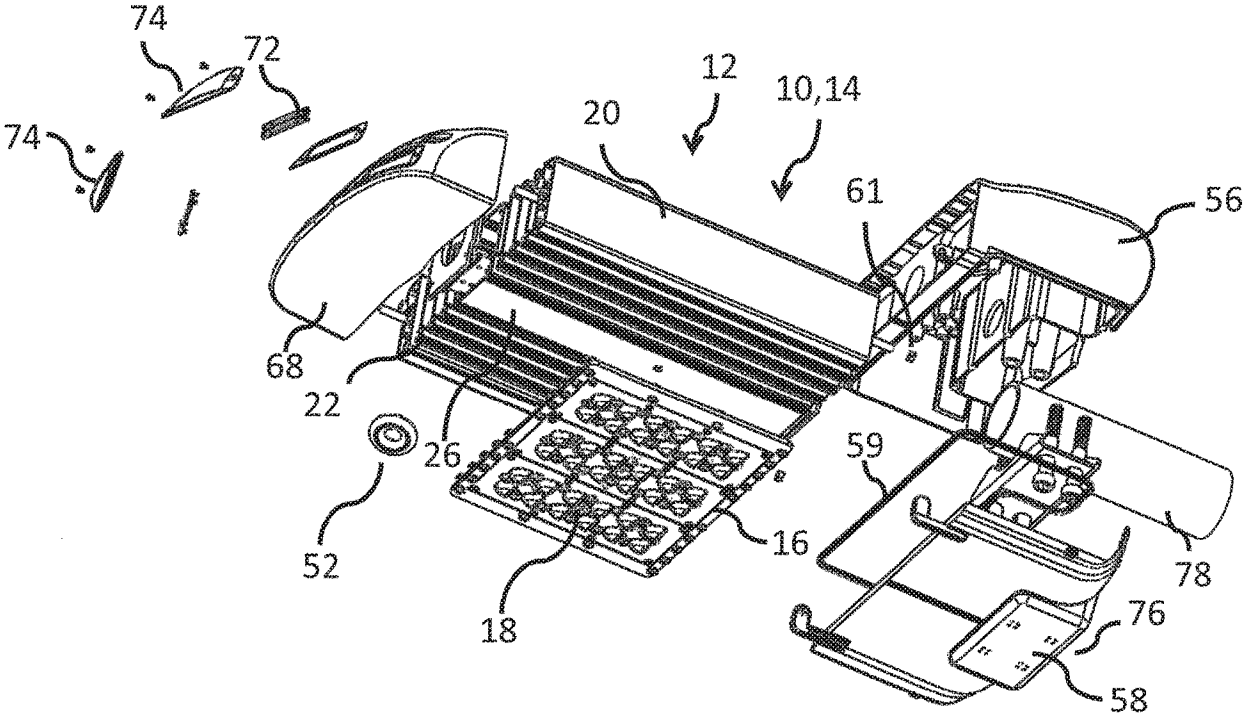
FIG. 1 is an exploded perspective view of a solid state lighting apparatus.

Referring to the Figures there is shown a solid state lighting apparatus 10. The solid state lighting apparatus 10 includes extrusions 12 running longitudinally relative to the luminaire 14. The extrusions 12 may attach to a mounting plate 16 that also receives and attaches LEDs that may be used as street lighting to illuminate a desired area positioned below the solid state lighting apparatus 10. The extrusions 12 act as heat sinks to cool the LEDs 18 and to also dissipate heat from additional heat sources such as a power supply and any other electrically active internal components during operation. The extrusions 12 may include various types. The outermost extrusions or side rail 20, one on each side of the solid state lighting apparatus 10, may be used as structural supports while also functioning to carry heat away from the mounting plate 16. The various types of extrusions 12 may be individual components or independent of each other. In this manner the extrusions 12 are thus smaller and being small, can have much thinner walls than would be the case for a single larger extrusion. The extrusions 12 thus can be made lighter and use less material resulting in a more economical construction.

Another type of extrusion 12 is the fin extrusions 22, which as depicted in FIGS. 1-3, 3, 5 include three extrusions 22 that are spaced from each other with the first extrusion 22 being adjacent to the side rail 20 with adjacent extrusions 22 each being placed inward toward a center of the solid state lighting apparatus 10. The extrusions 22 attach to the LED mounting plate 16 and they act like the fins of a heat sink. There are also three additional extrusions 22 on an opposing side of a center channel 26 for a total of six of the fin type extrusions 22 shown in the depicted embodiments. It should be realized that various numbers of fins type extrusions may be utilized based on the desired properties of the solid state lighting apparatus 10 including the amount of LEDs and the need to dissipate various amounts of heat. The fin extrusions may have an I beam configuration to prevent ingress of foreign matter from the top and to accommodate slot formation as will discussed in more detail below.

All the extrusions 12 can be cut to the length required to achieve the desired level of heat transfer from the LEDs 18 and active electronics and the ambient air. In this manner the extrusions are scalable and adjustable to accommodate various numbers of LEDs.

In one aspect, the extrusions 12 allow air to flow upward as it is heated, between the extrusions 12 providing heat transfer. The portion of the extrusions 12 directly above the mounting plate 16 does not allow air to flow all the way from the bottom to the top because the mounting plate 16 blocks the path of the air at the bottom. However, the air can still flow in from the open areas fore and aft of the LED holding plate 16. The most efficient convective air flow is in the regions where the air can flow unimpeded, inward between the extrusions and all the way to the top and out again. The length of the extrusions 12 can be adjusted to ensure desirable levels of heat transfer and provide desired operational temperatures.

Figure 2:
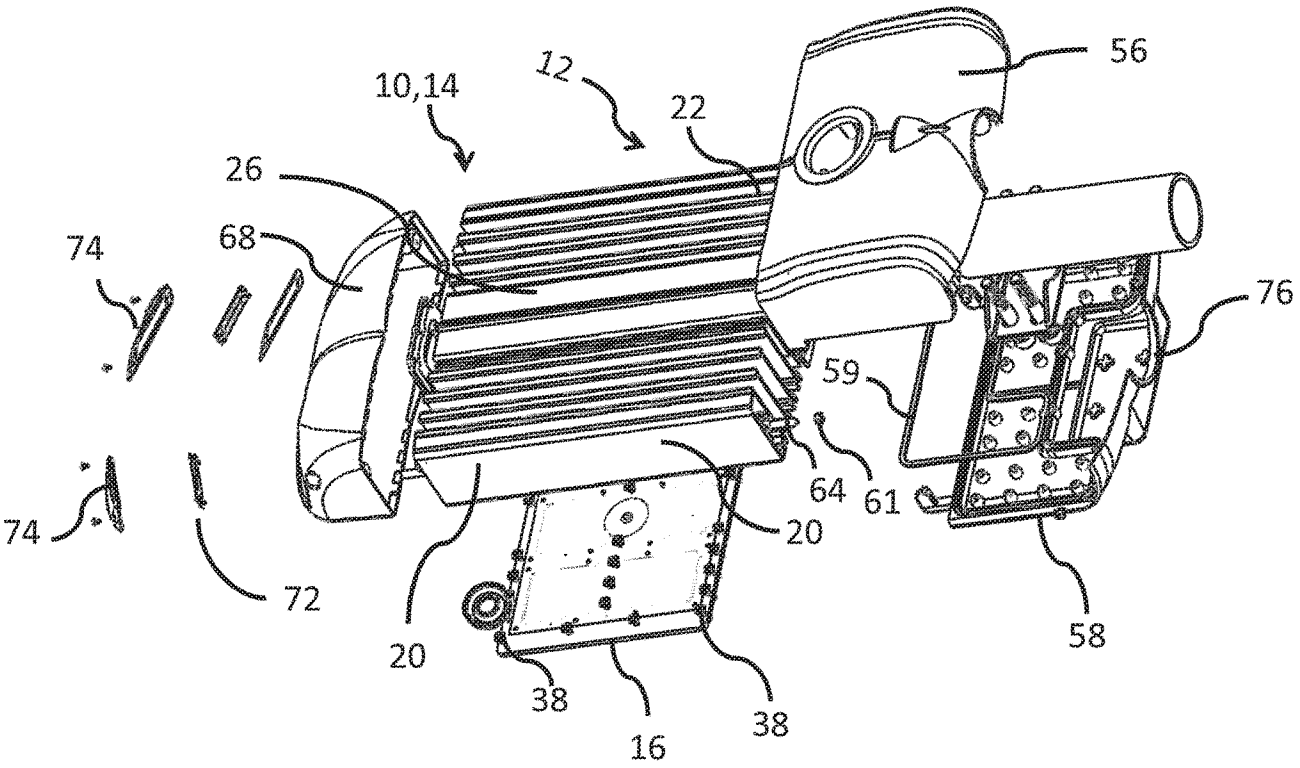
FIG. 2 is an exploded perspective view of a solid state lighting apparatus.
Figure 3:
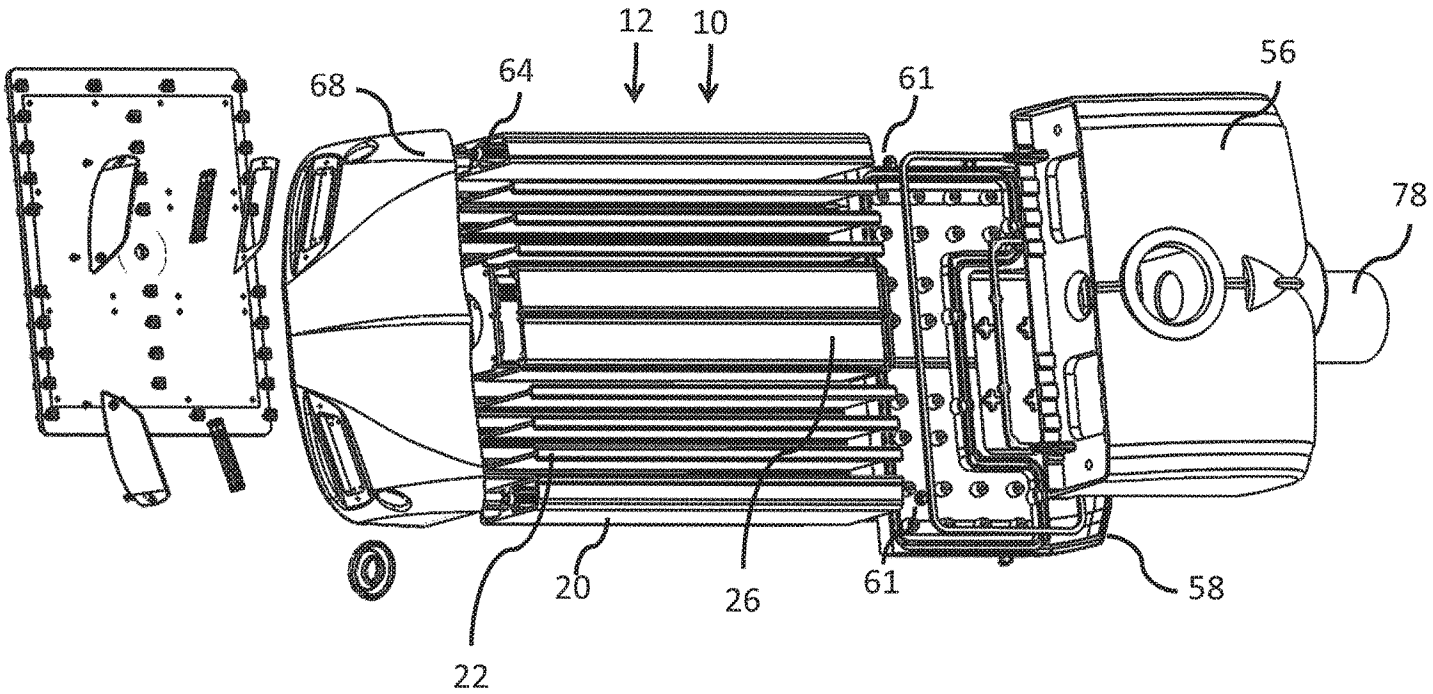
FIG. 3 is an exploded perspective view of a solid state lighting apparatus.
Figure 6:
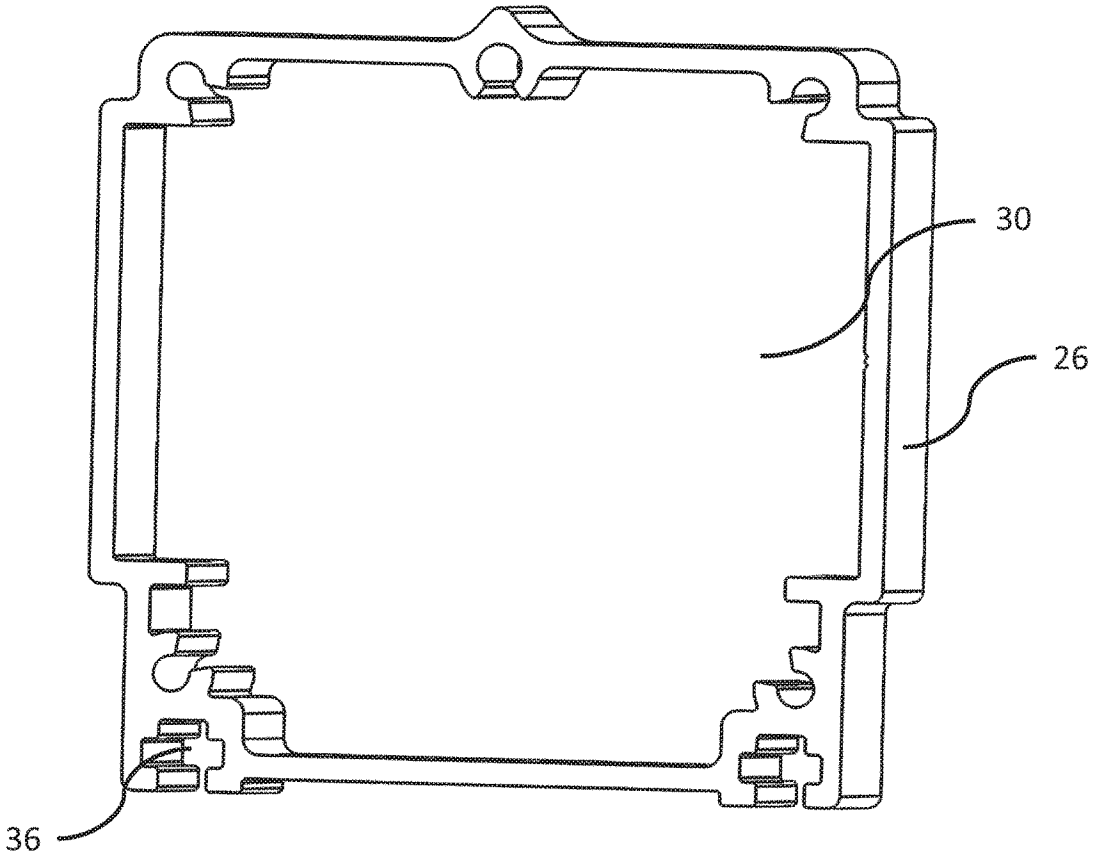
FIG. 6 is a perspective view of an center extrusion.
Figure 7:
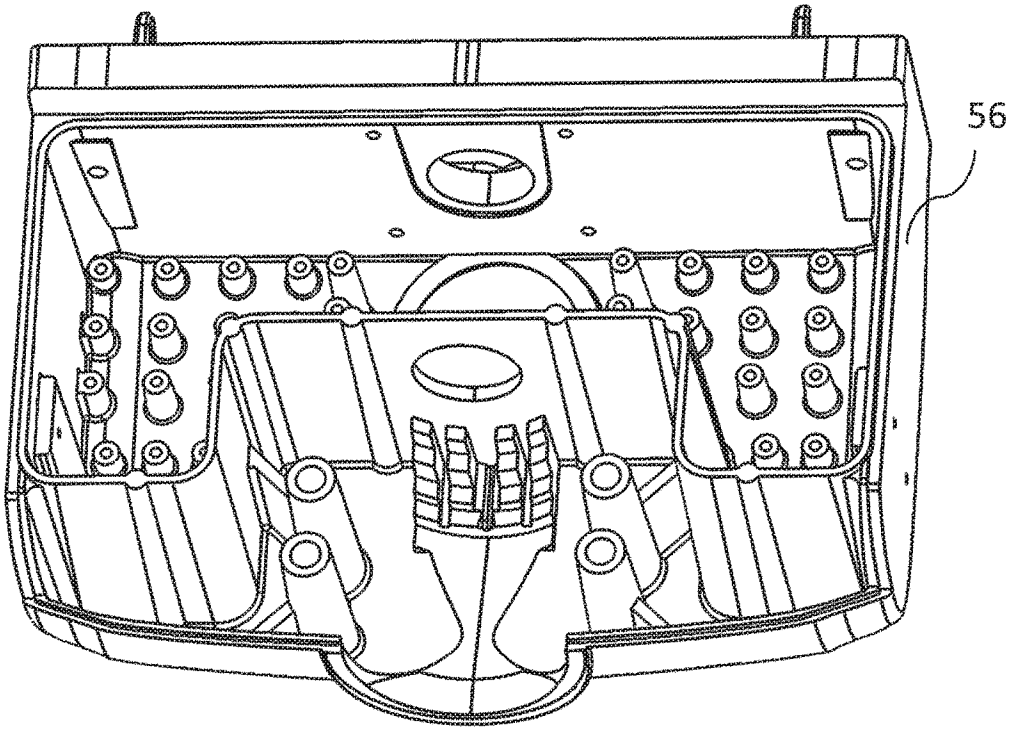
FIG. 7 is a view of the inside of the back enclosure.
Figure 8:
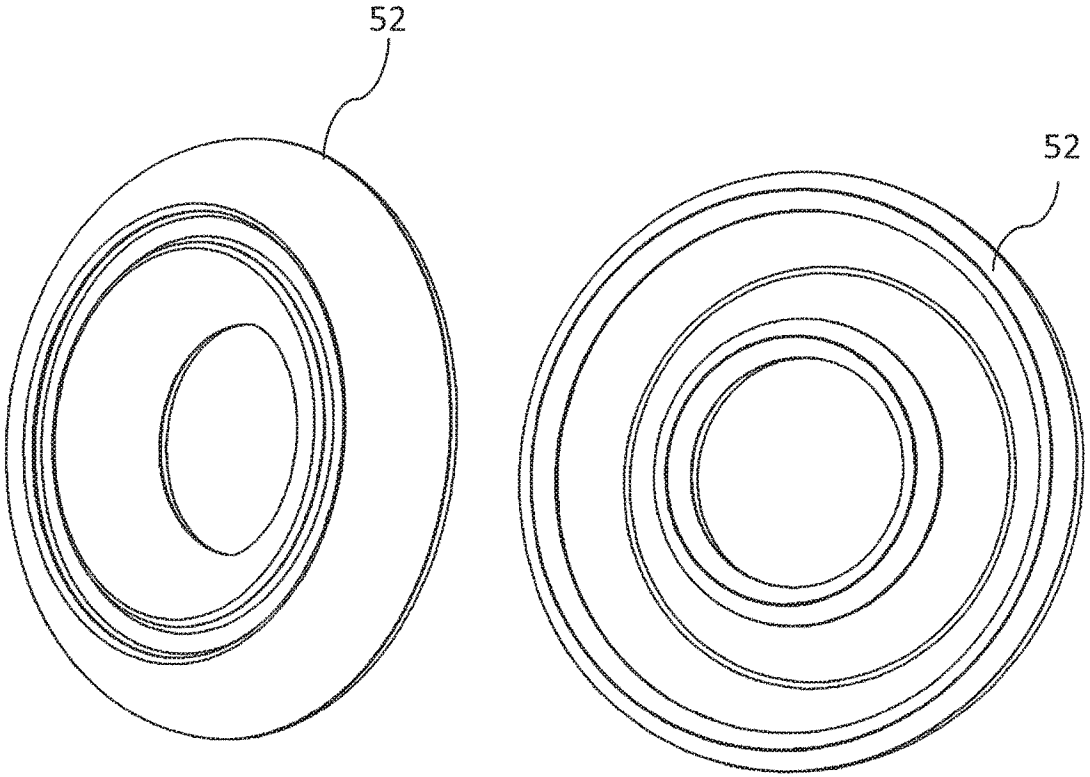
FIG. 8 is a perspective view of a gasket.
Figure 9:
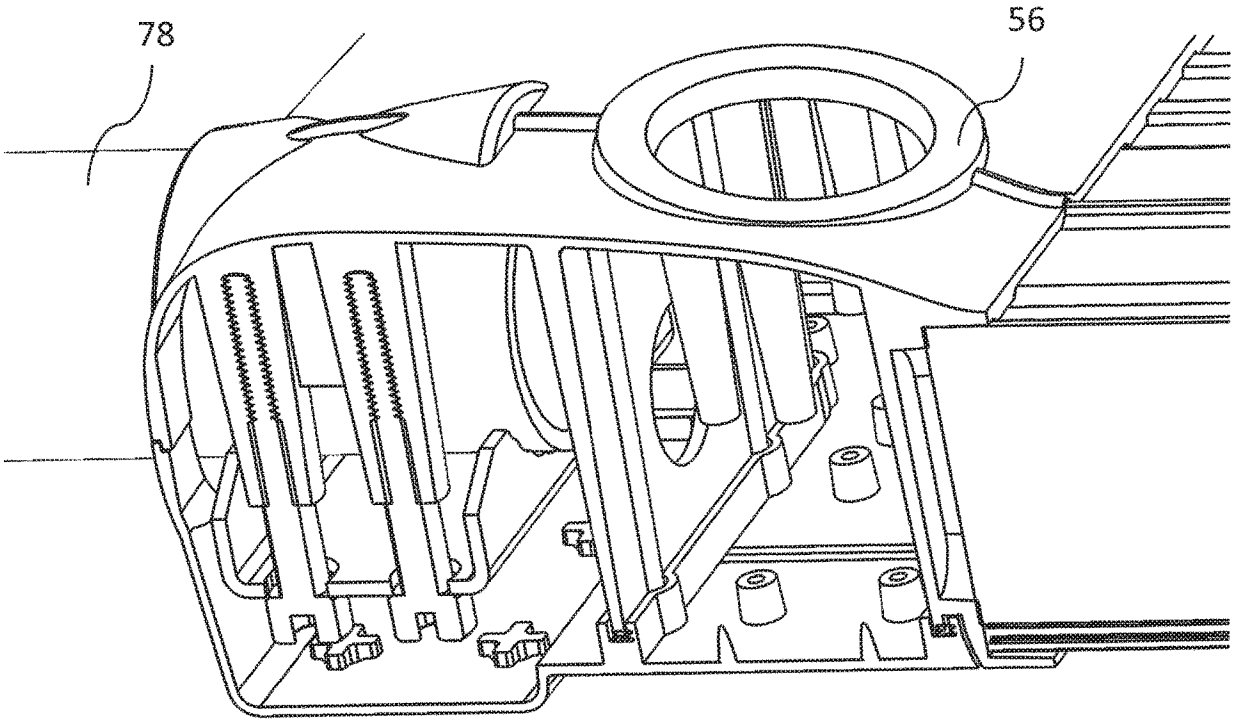
FIG. 9 is a-side view of the back enclosure cross section.

Referring to FIGS. 1-2 and 6, the center extrusion 26 has a hollow cross section 30 that forms an enclosure that may receive structures such as LED drivers, batteries and other electronics. The center extrusion 26 length can be varied to accommodate greater or lesser units of electronics. Both ends of the center extrusion 26 when in the assembled state are sealed against the external elements. The center extrusion 26 allows electronics to be scalable as the number of LEDs 18 increases and the length of the center extrusion 26 increases.

Figure 16:
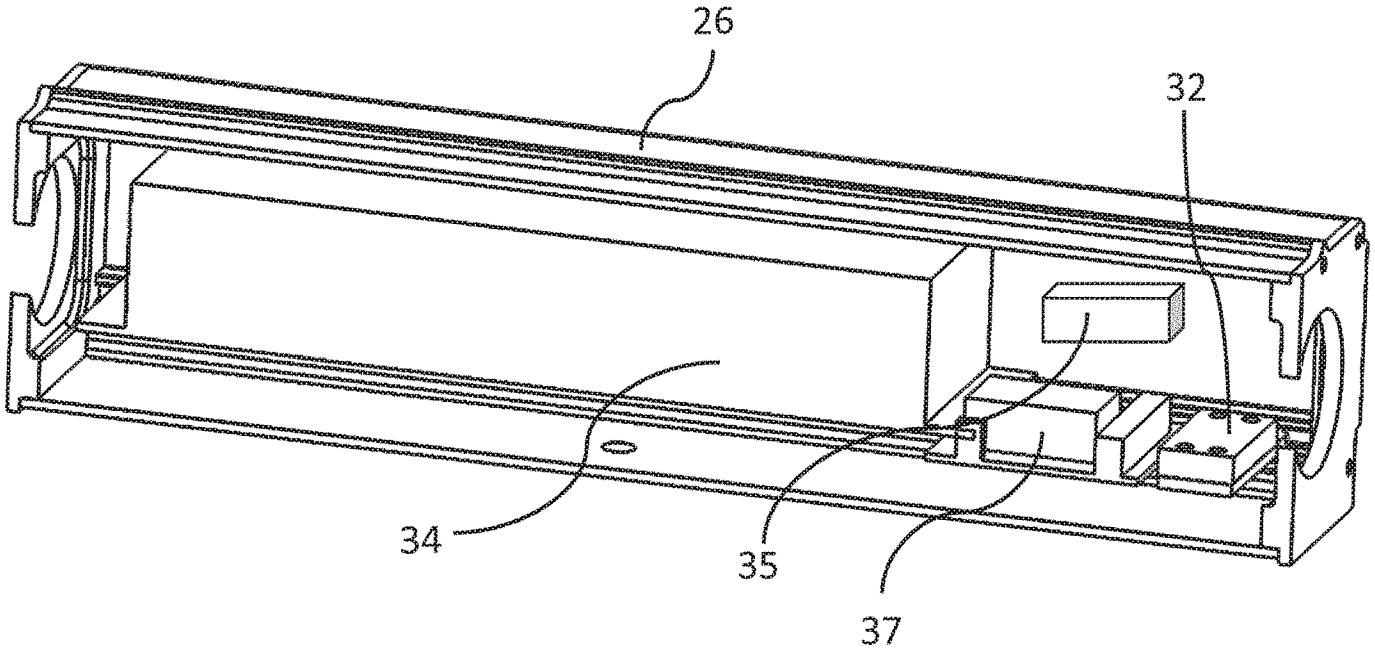
FIG. 16 is a partial cut away perspective view of a center extrusion showing electronics.
Figure 17:
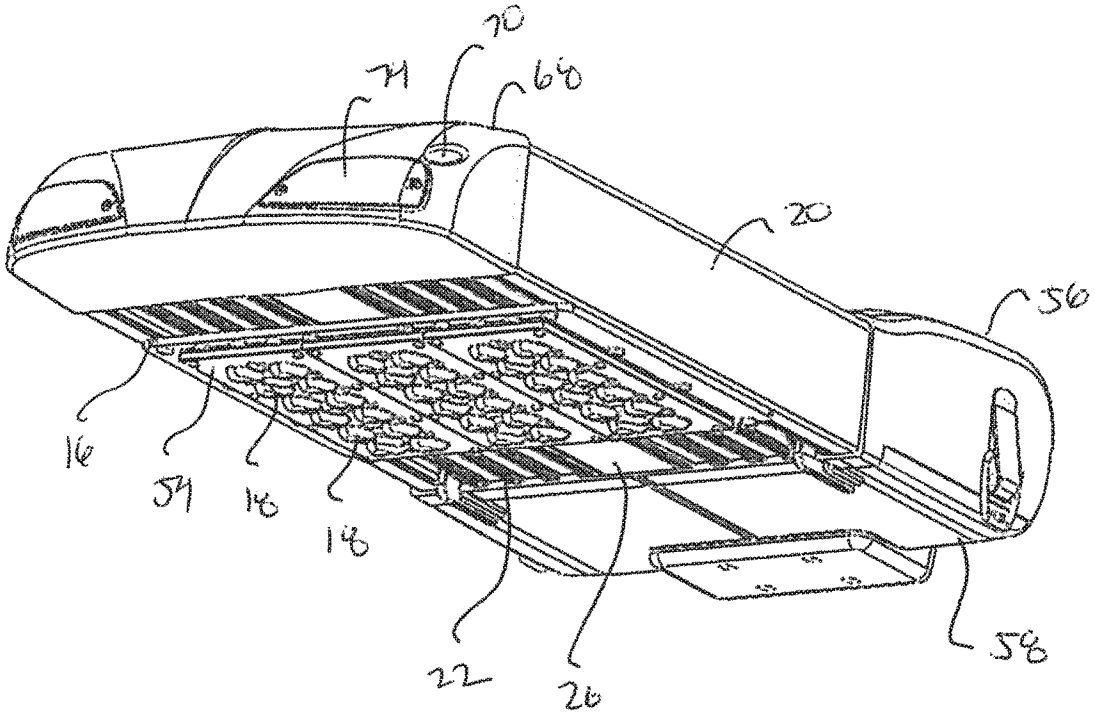
FIG. 17 is a perspective view of the bottom of a solid state lighting apparatus.

The center extrusion 26 also may contain electronic circuitry 37, best shown in FIG. 16 as an overlay for powering the LEDs 18 from an onboard battery so that the Luminaire 14 keeps providing light when the grid AC power is interrupted. The circuitry 37 detects darkness through an independent photo-resistor 32. The photo-resistor is water proofed and provided optical access to the exterior so that it can detect light and modify its internal resistance. The circuitry 37 detects the resistance of the photo-resistor 32 and thus can detect daylight, which causes a low resistance. The circuitry 37 may also contain terminals that detect AC voltage across two or more wires attached to these ports. When the photo resistance is high, indicating darkness, and the AC voltage is not present then the circuit 37 activates backup power from the battery 35 to an independent, separate DC driven LED driver 34. The net result is that backup power is provided when needed and not when it is not needed, such as in daylight. This LED driver 34 is controlled by a microprocessor to allow adjustment of power output to the LEDs 18 and LED runtime. In this manner the solid state lighting apparatus 10 may provide un-interrupted illumination even during power outages. The center extrusion 26 has one or more holes that connect with holes in the back enclosure to provide passage for wires from the center channel to the back enclosure to allow power and signals to be sent back and forth between the interior of the back enclosure and the interior of the center channel.

Figure 4:
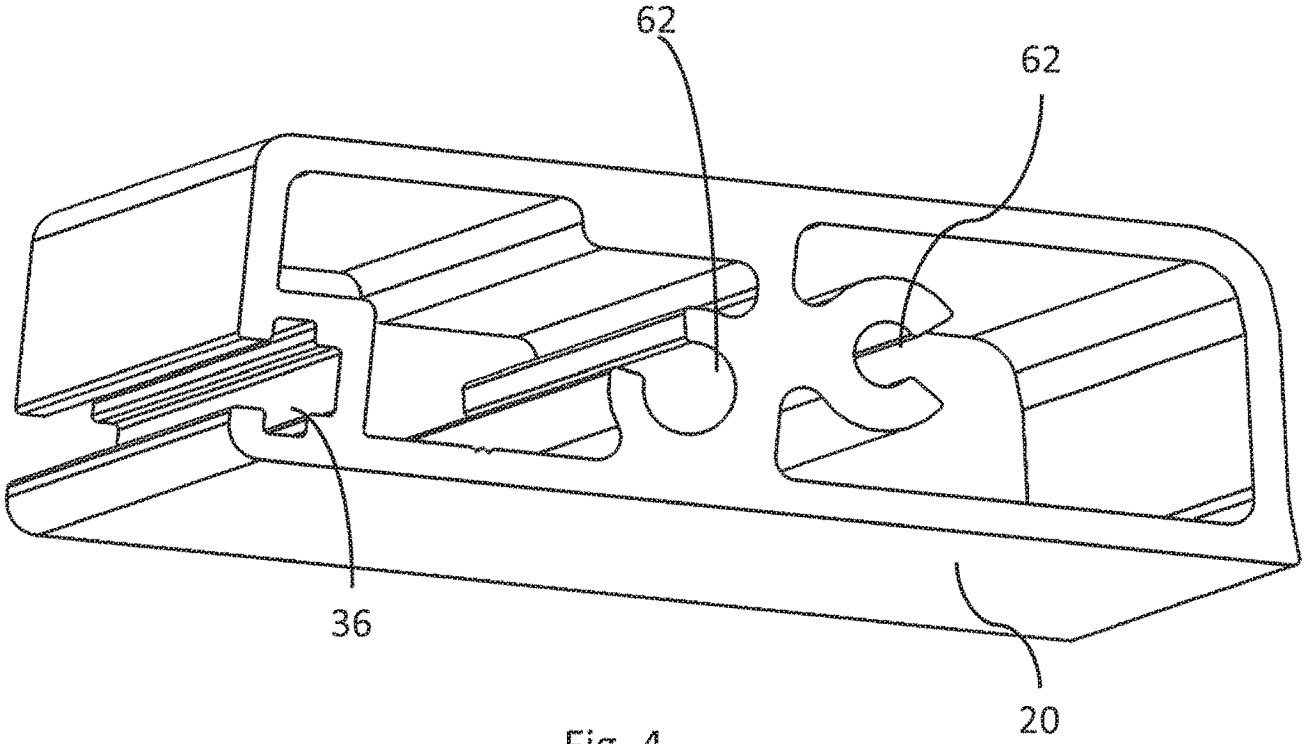
FIG. 4 is a perspective view of a side rail extrusion.
Figure 5:
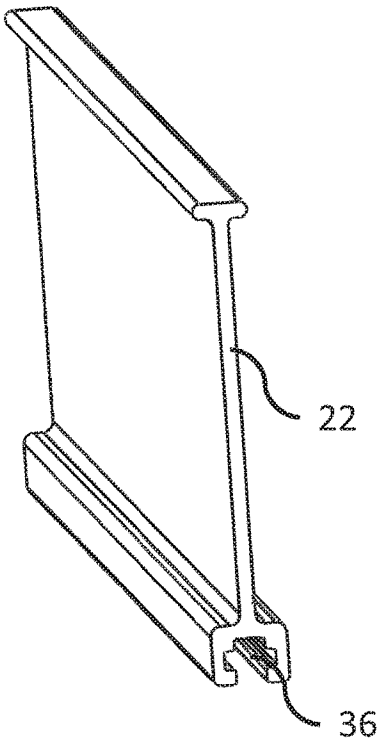
FIG. 5 is a perspective view of a fin extrusion.

Referring to FIGS. 4-6 each of the extrusions 12 including the side rail 20, fin extrusion 22 and the center extrusion 26 has a T shaped slot 36 in it that allows square or rectangular or similar shaped nuts 38 having two parallel external faces to slide along the slot 36. The nuts 38 may slide along the T shaped slot to allow placement of screws for attachment, as desired anywhere along the accessible length of the extrusions 12. This structural arrangement eliminates the need to make special drilling jigs to make specific hole patterns whenever a design is modified. The slots 36 allow the screws for attachment to be positioned anywhere along the accessible length of each extrusion 12. In one aspect, the mounting plate 16 may include nuts 38 attached thereon as will be described in more detail below.

Figure 14:
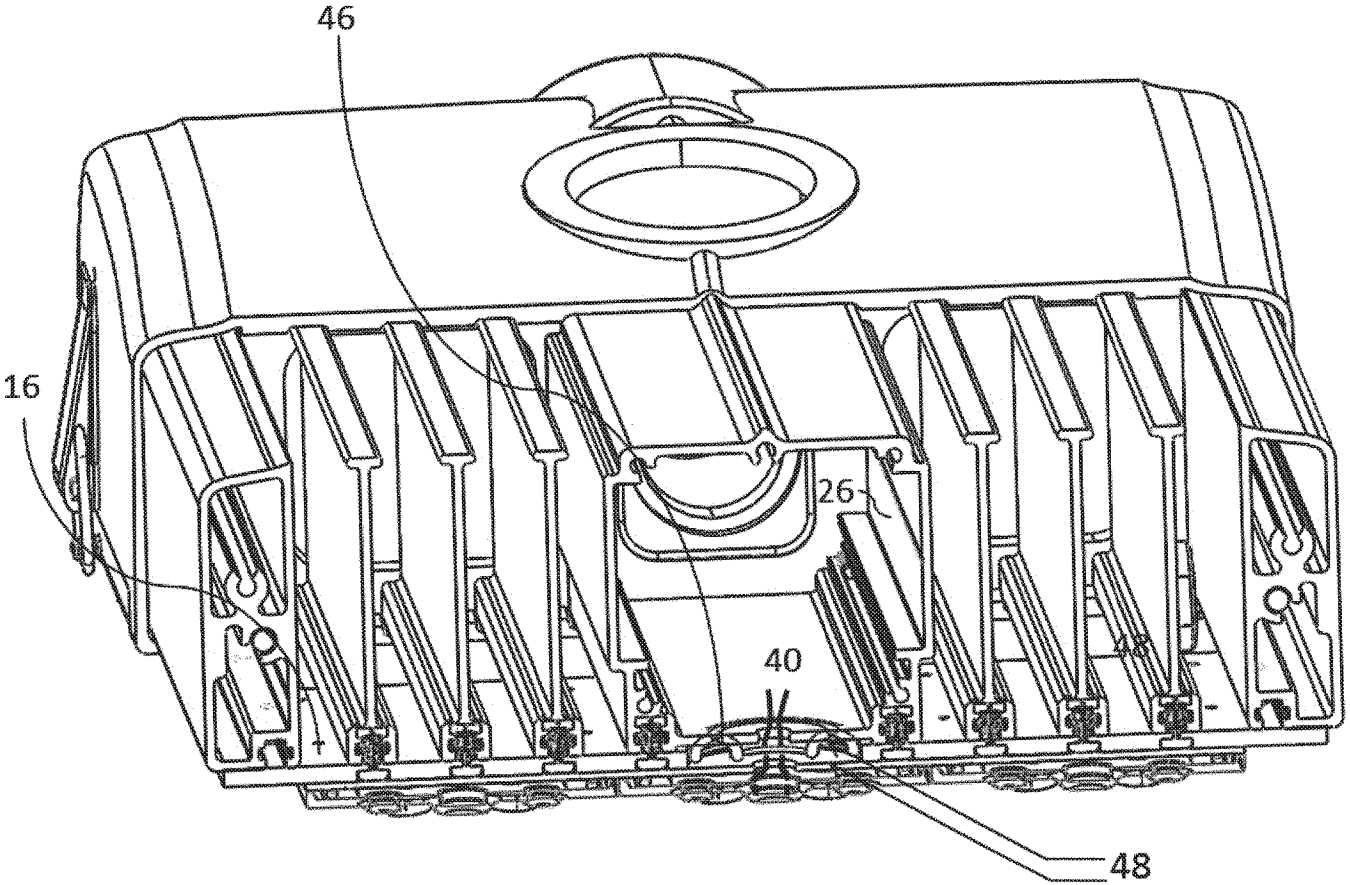
FIG. 14 is a view of the gap between the LED Main Circuit Board and the bottom surface of the center extrusion with the center extrusion pulled back.
Figure 15:
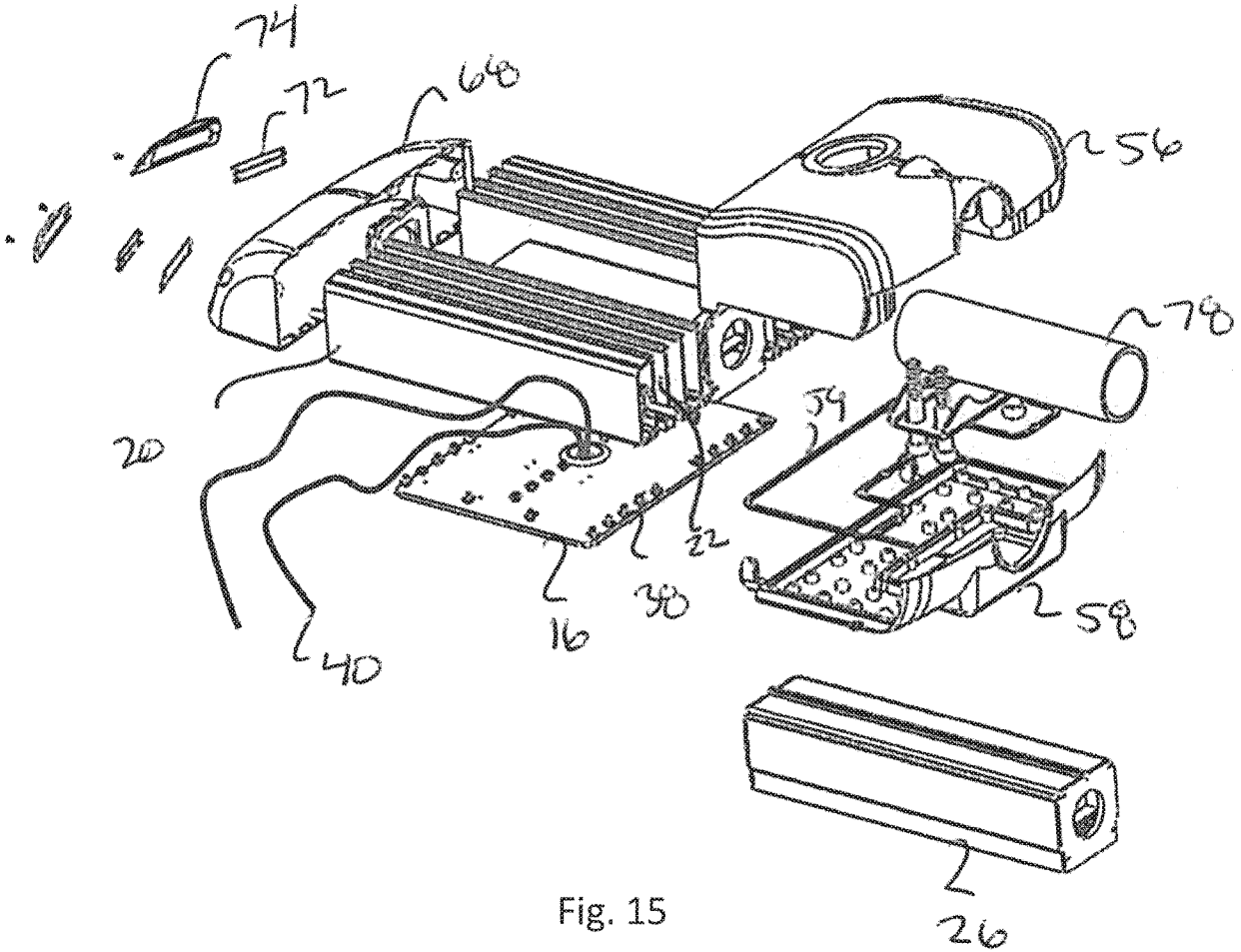
FIG. 15 is a perspective view of a solid state lighting apparatus.
Figure 33:
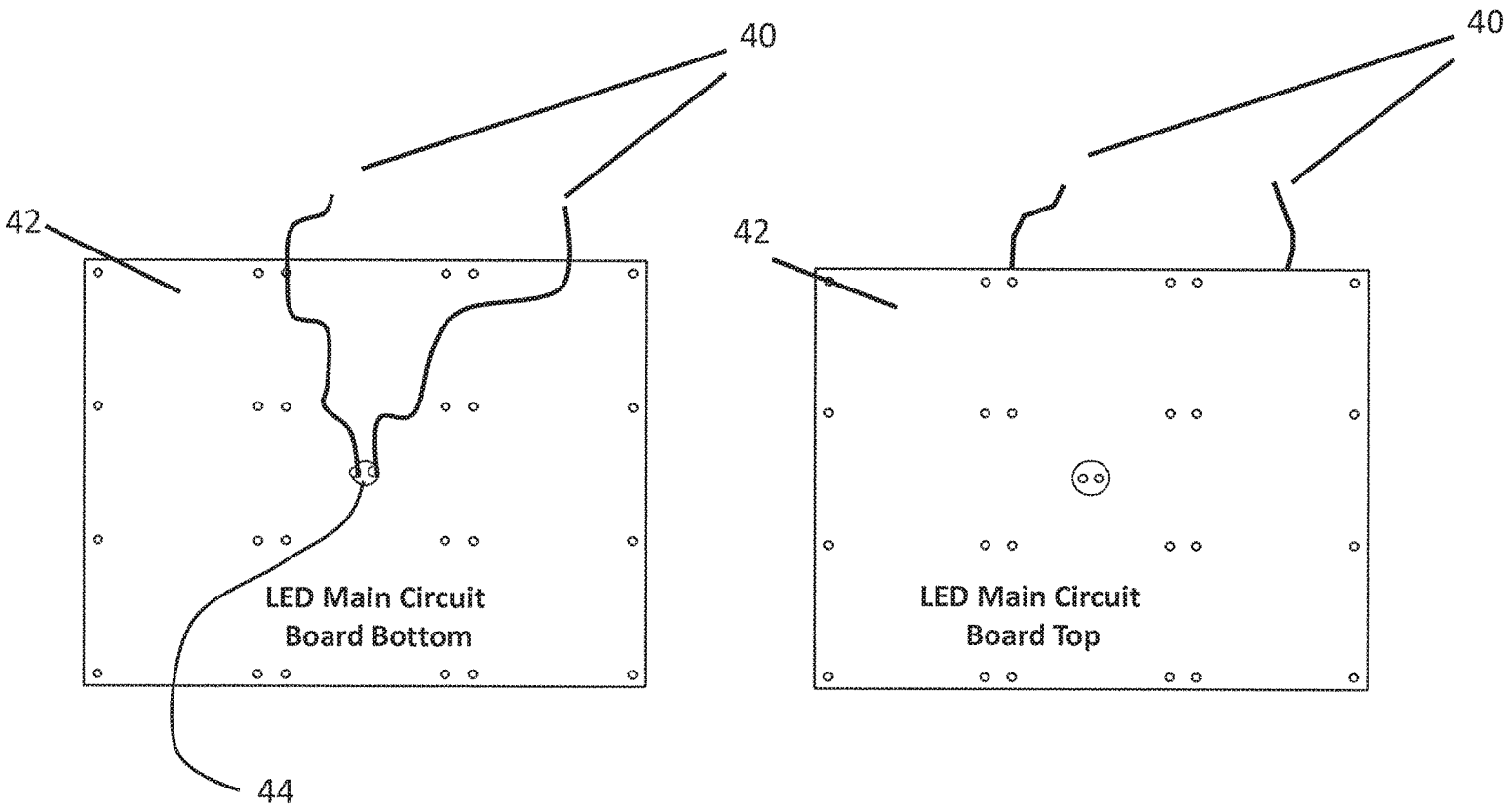
FIG. 33 is a view of the top and bottom of the main led circuit board.

Referring to FIGS. 14 and 15, and 33, wires 40 coming from the circuit board 42 that provides power to the LEDs 18 goes through a hole 44 in the circuit board 42 and through a larger hole 46 in the mounting plate 16 and across a gap 48 to a hole 50 in the bottom of the center extrusion 26, also smaller than the hole 46 in the LED mounting plate 16. A gasket 52 runs between the circuit board 42 through the hole 46 in the mounting plate 16 and up against the bottom of the center channel extrusion 26. The gasket 52 compresses between the circuit board 42 and the center channel extrusion 26 and thus seal the hole in the Main LED Circuit board 42 and the hole 50 in the center channel extrusion 26.

Figure 10:
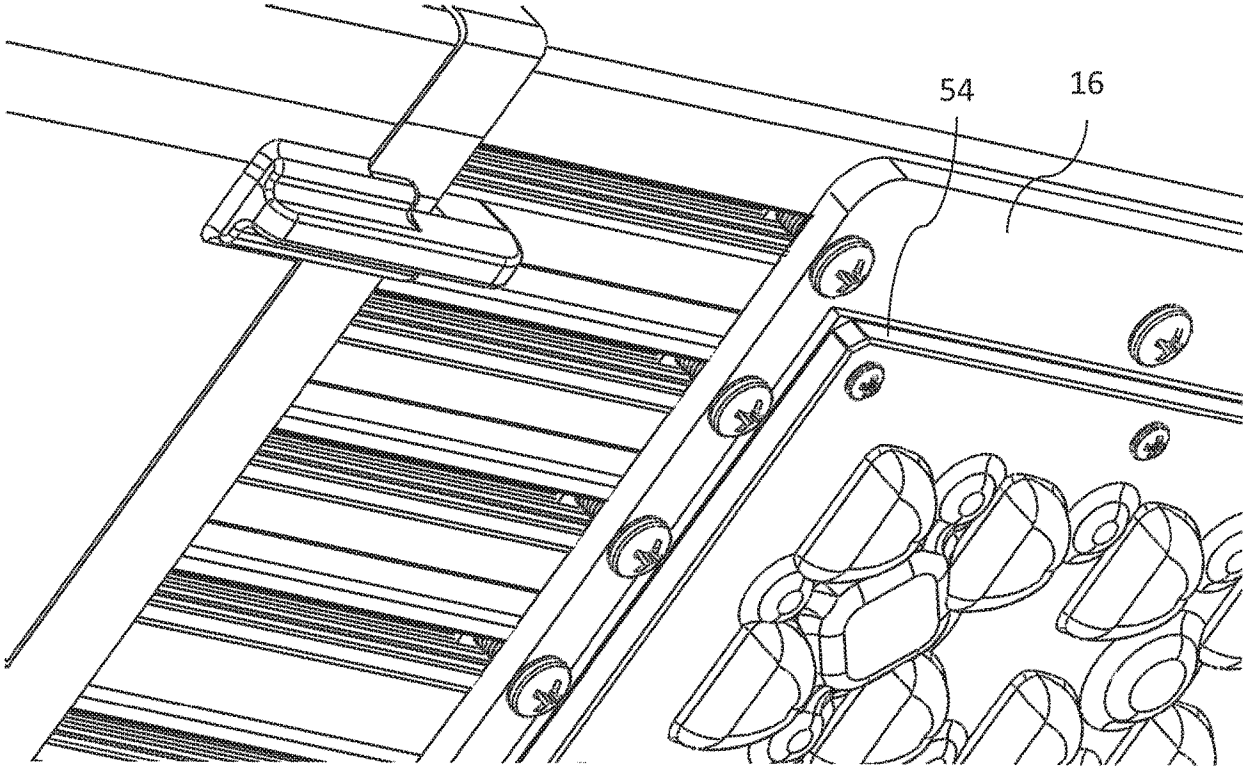
FIG. 10 is a partial perspective view of the mounting plate, extrusions and rod.
Figure 11:
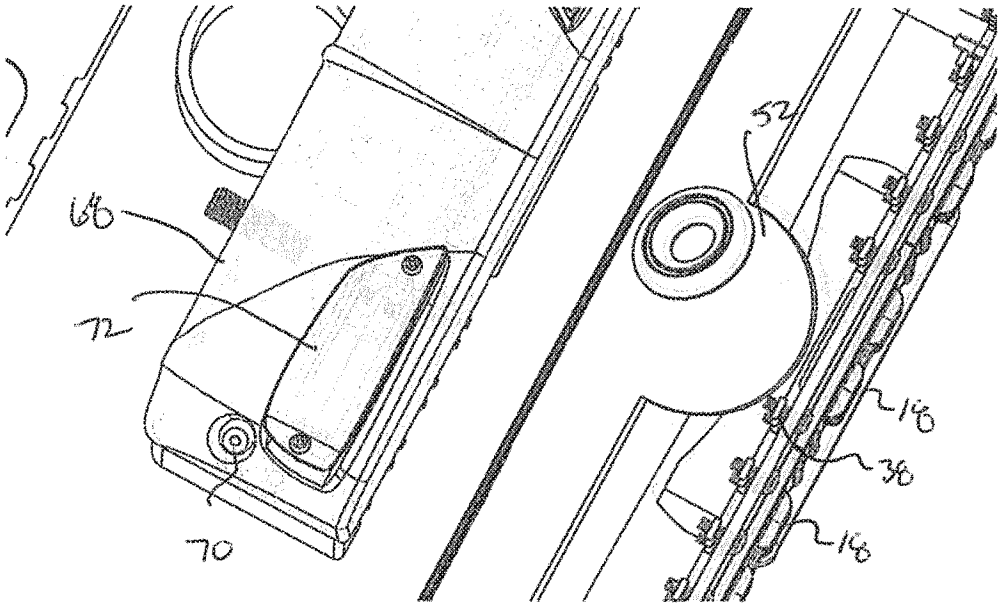
FIG. 11 is a partial perspective view mounting plate, gasket and front enclosure.
Figure 12:
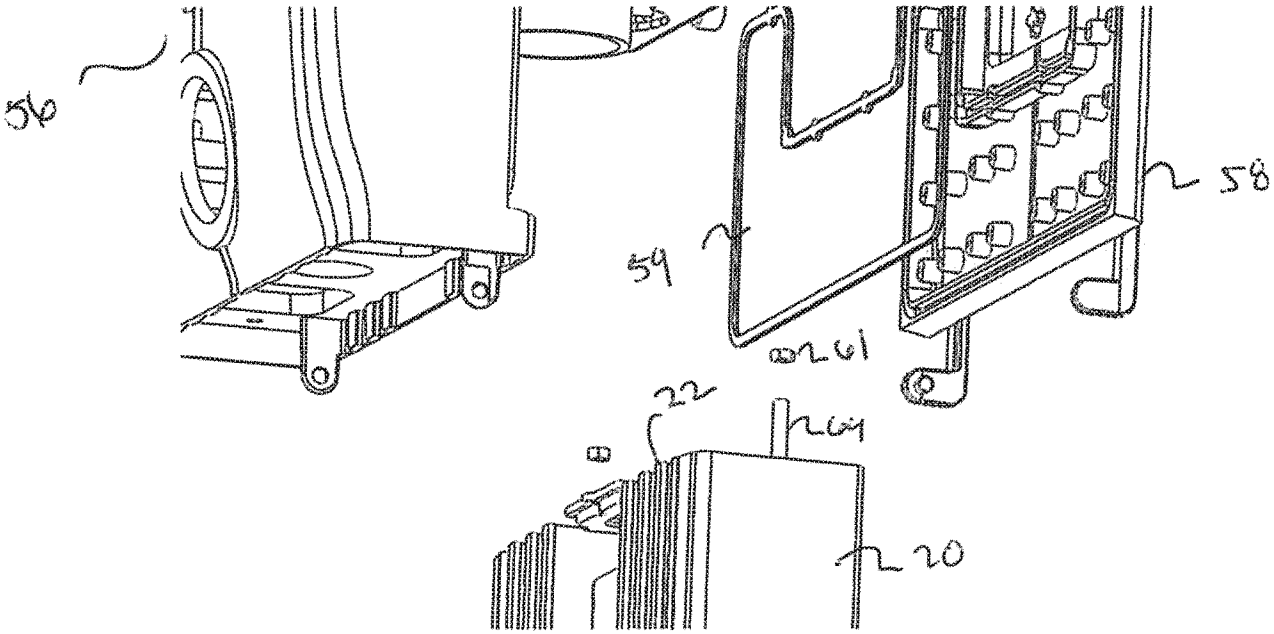
FIG. 12 is a partial perspective view of the mounting plate, extrusions and rods.
Figure 13:
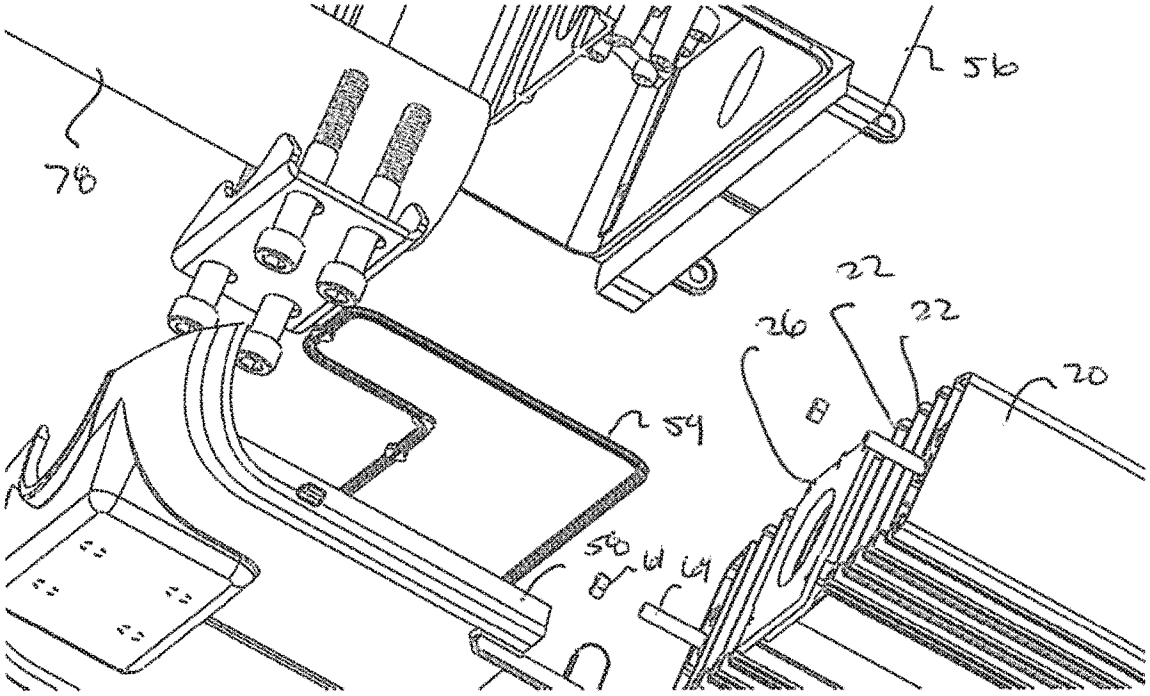
FIG. 13 is a partial perspective view of mounting structure and back enclosure.

Referring to FIG. 10, a gasketed cover 54 may be attached to the mounting plate 16 using screws or other fasteners. The cover 54 includes a gasket that seals against the mounting plate 16 to protect the circuit board 42 thus sealing the holes 46, 50 from the other side. The gasket 52 between the circuit board 42 and the center channel extrusion 26 allows the wires 40 from the circuit board 42 to pass through the gap 48 and into the hole 50 in the center channel extrusion 26. The wires 40 are thus not seen and are sealed from the environment.

Referring to FIGS. 1-2, 7, 9, 13, 15 the solid state lighting apparatus 10 may include a first or back enclosure 56 that contains areas for electronics and also for a power wire terminal connection block. The enclosure includes a top surface and side surfaces with an open bottom. A lower hinged door 58 is attached to the back enclosure to allow access to the interior of the enclosure. The hinged door 58 includes a gasket 59 that seals between the enclosure 56.

Referring to FIGS. 1-2, 4, 13 the side rails 20 each have 2 different holes 62 (complete or partial in circumference) running longitudinally in them. One of the holes 62 carries a threaded rod 64, which may be formed of stainless steel. The threaded rod 64 threads into the back enclosure 56. A thread sealant may be utilized to provide protection against water ingress along the threads. A nut, 61, which may be formed of stainless steel nut may be attached to the threaded rod 64 to join the back enclosure and side rails 20. The nut 61, provides additional tightening and long term security of attachment. There may be over time degradation in the strength of the aluminum threads due to galvanic action between the stainless and the aluminum. The stainless nut at the end of the rod 64 makes sure that the structural integrity is maintained over the entire service life of the assembly. The side rail extrusion 20 slides over the stainless rod 64 which fits inside one of the two longitudinal holes 62. Another nut, stainless in our embodiment, attaches to the other end of the rod 64 and tightens over the side rail 20 thus securing it tightly to the back enclosure 56. The opposing side rail 20 attaches in the same fashion with mirror image symmetry. The side rails 20 and the back enclosure thus form a structural unit that operates independently of the front enclosure 68, which can thus be attached or removed independently.

The other hole 62 in the side rail 60 is threaded to accept a screw to allow attachment of the front enclosure 68. The front piece 68 has two holes 70 spaced laterally that allow a screw to thread into the other hole 62 in the side rail on each side. The front enclosure 68 can thus be screwed onto the side rails 20 on both sides to attach it and it can be removed by unscrewing these two screws.

The front enclosure 68 may include connected LEDs 72. These LEDs 72 may be utilized as another light source and can flash as a warning to people. The LEDs 72 have weather proofing lenses, 74, that direct the light according to a desired pattern. All the lights along a particular street could also flash so that the entire street is distinguished from other streets. This could be used to alert people to escape routes for such phenomenon as tsunami. The LEDs 72 can also flash quickly to transmit data to other lights or to other receivers elsewhere.

Figure 18:
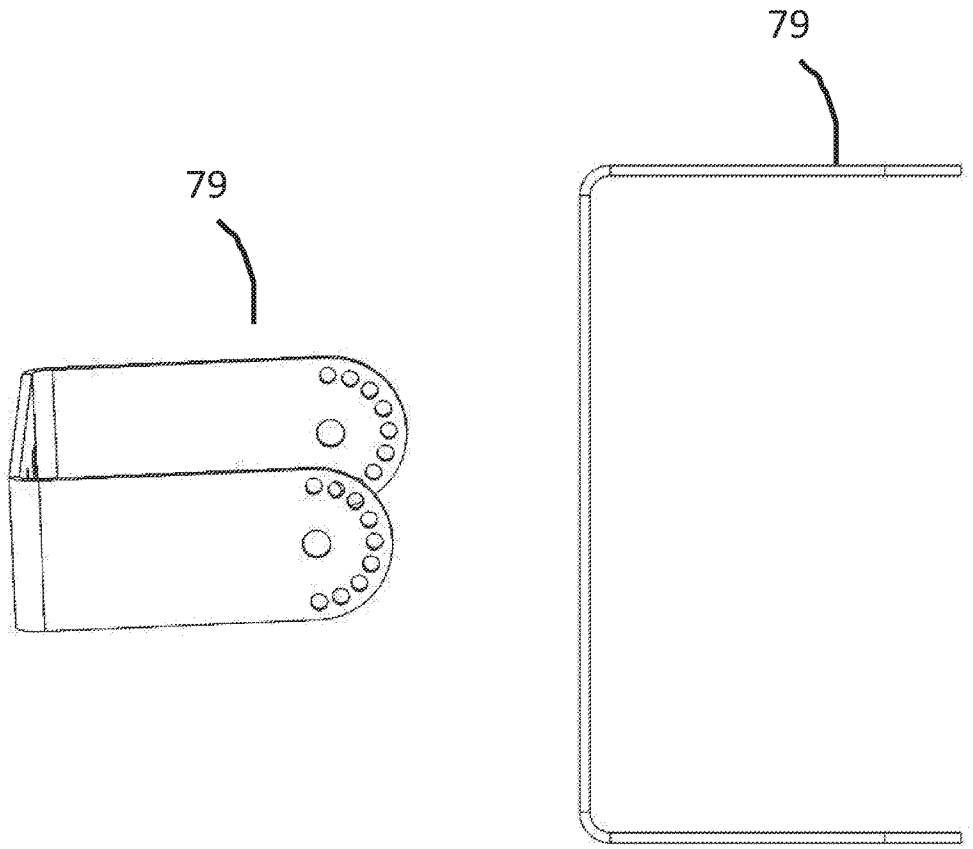
FIG. 18 is a top and side view of bracket that can be used for a tunnel light.
Figure 19:
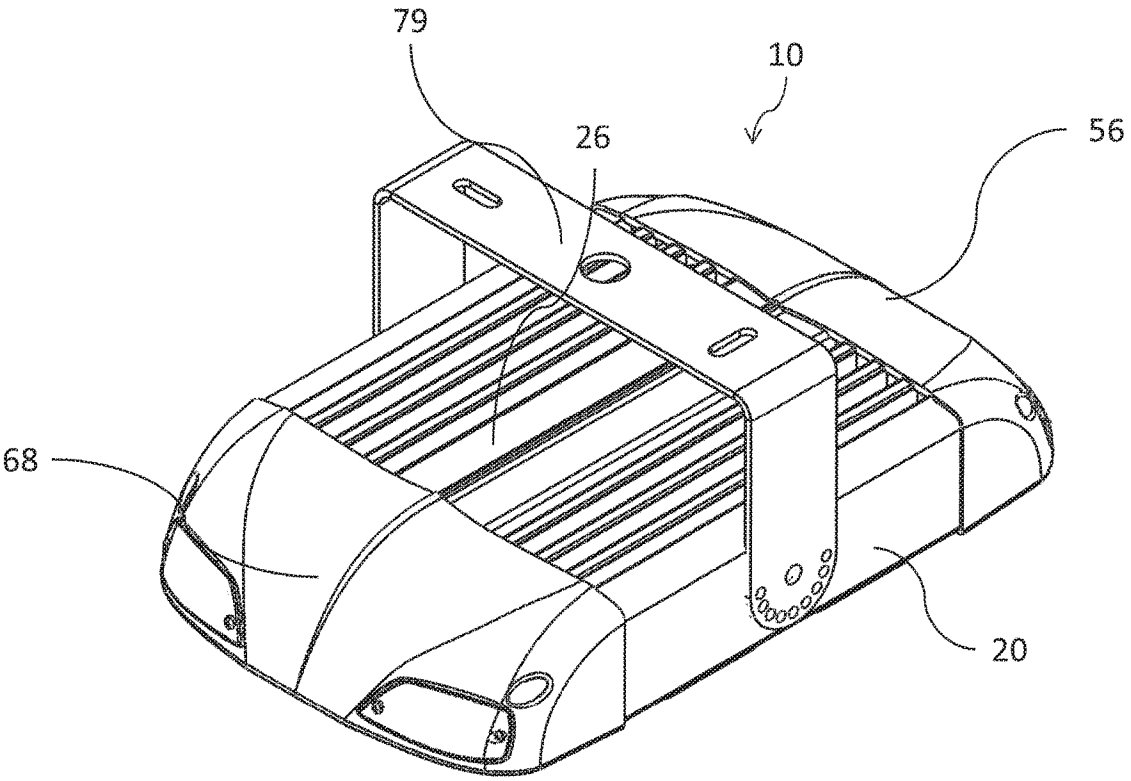
FIG. 19 is a perspective view of a tunnel light implementation of a solid state lighting apparatus.
Figure 20:
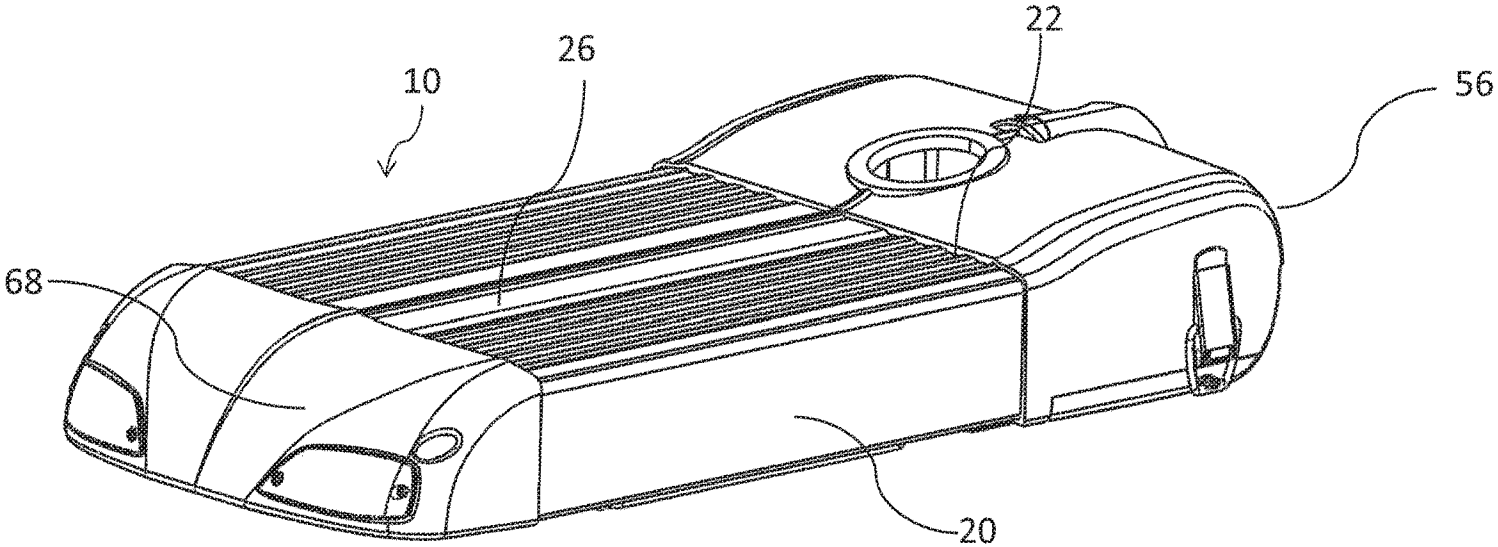
FIG. 20 is a perspective view of a solid state lighting apparatus.
Figure 21:
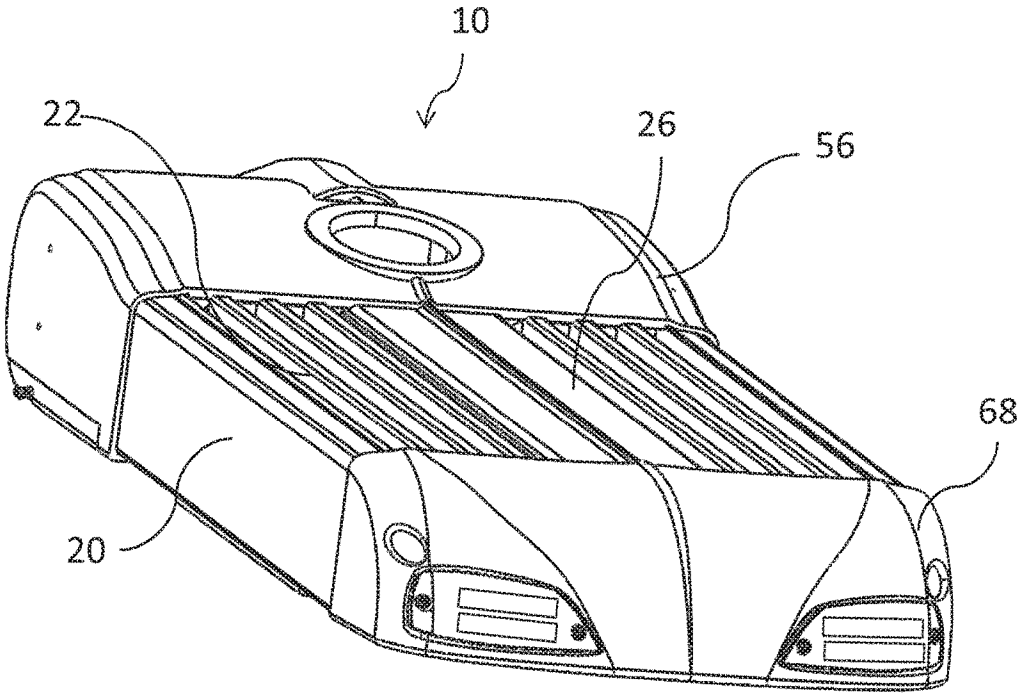
FIG. 21 is a front top perspective view of a solid state lighting apparatus.

Referring to FIGS. 1-3, 7, 9 the solid state lighting apparatus 10 includes a mounting structure 78, in the form of a cylinder positioned to pass into a slot 76 formed in the back enclosure 56. The mounting structure 78 may be utilized to position the solid state lighting apparatus 10 above a street or other desired surface. Alternatively, the mounting structure may include a bracket 79 as shown in FIGS. 18 and 19.

The solid state lighting apparatus 10 may be assembled to form a waterproof apparatus that allows for air to flow upward as it is heated, between the extrusions 12 providing heat transfer to cool the solid state lighting apparatus 10. The assembly procedure may described with reference to FIGS. 22-31.

Figure 22:
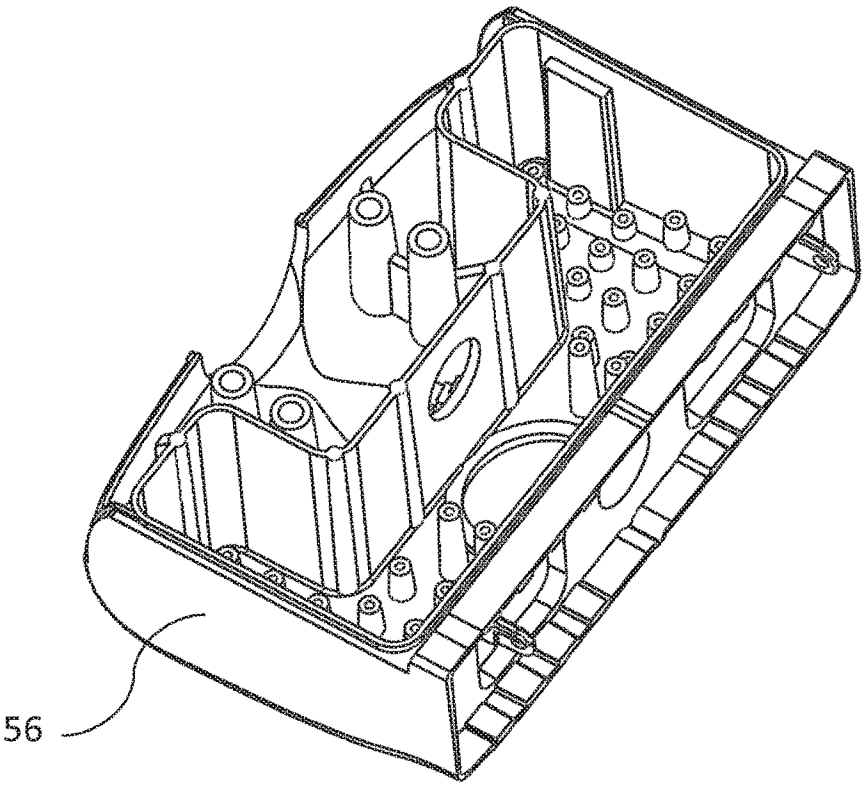
FIG. 22 is an assembly view of the back enclosure.
Figure 23:
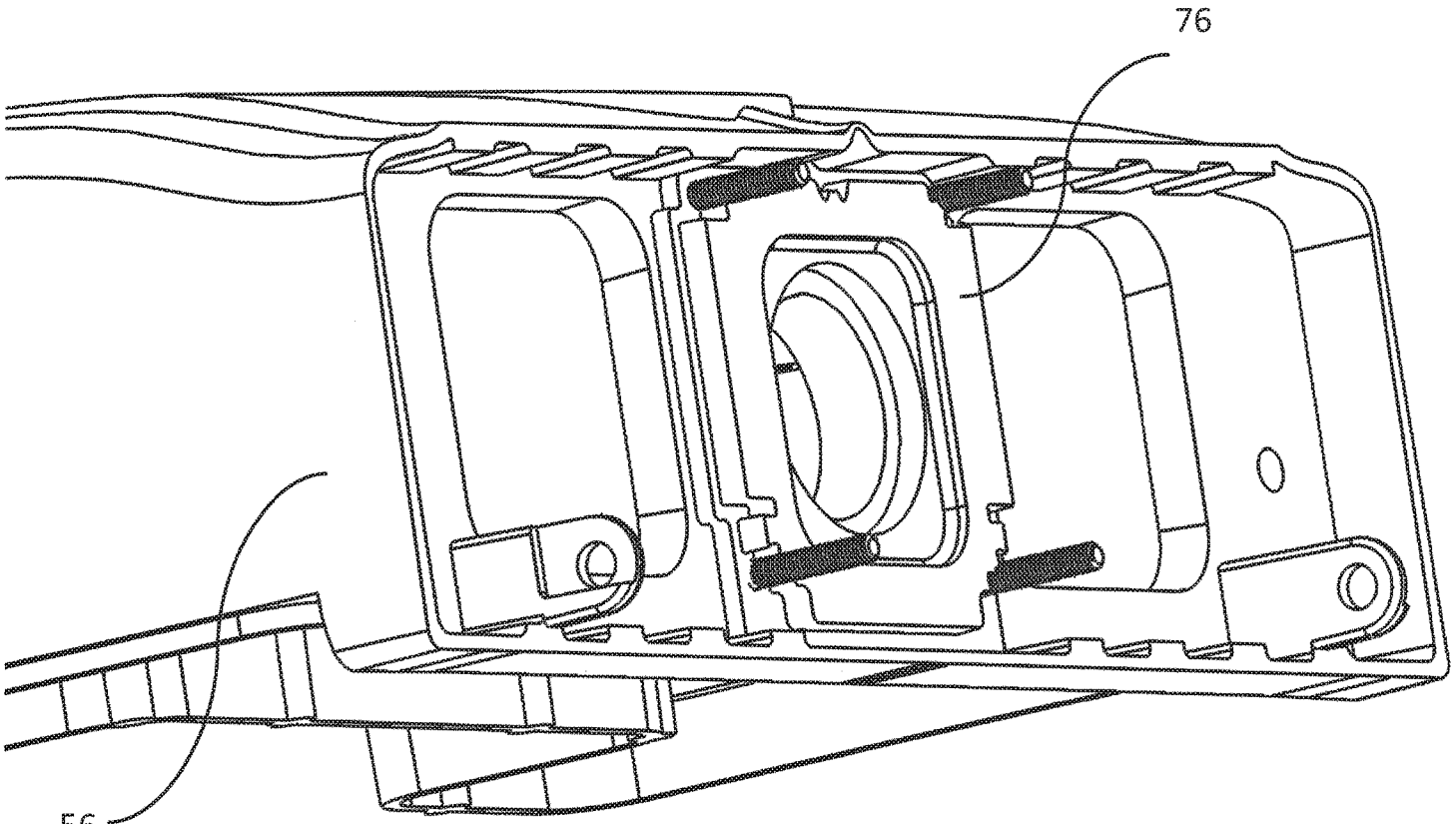
FIG. 23 is an assembly view of the back enclosure and center channel back gasket.
Figure 24:
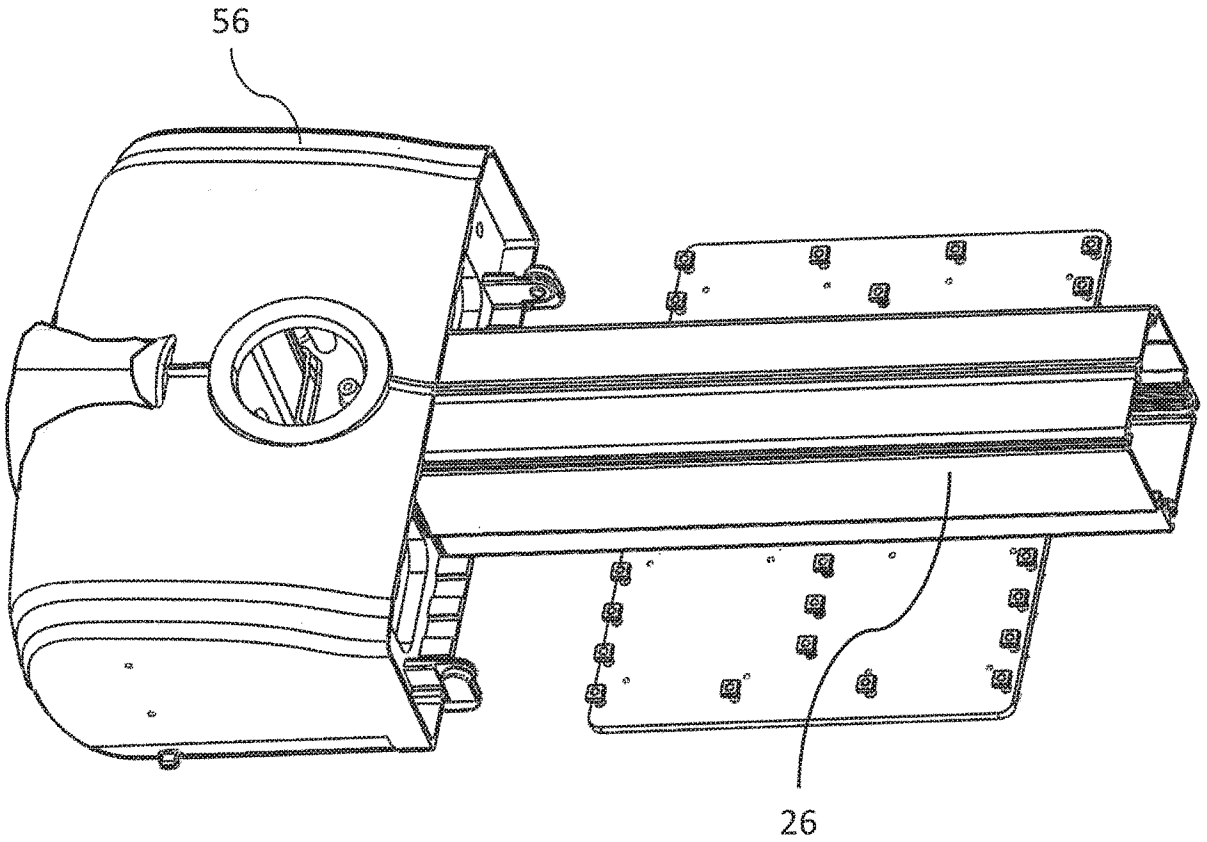
FIG. 24 is an assembly view of the center channel and back enclosure.
Figure 25:
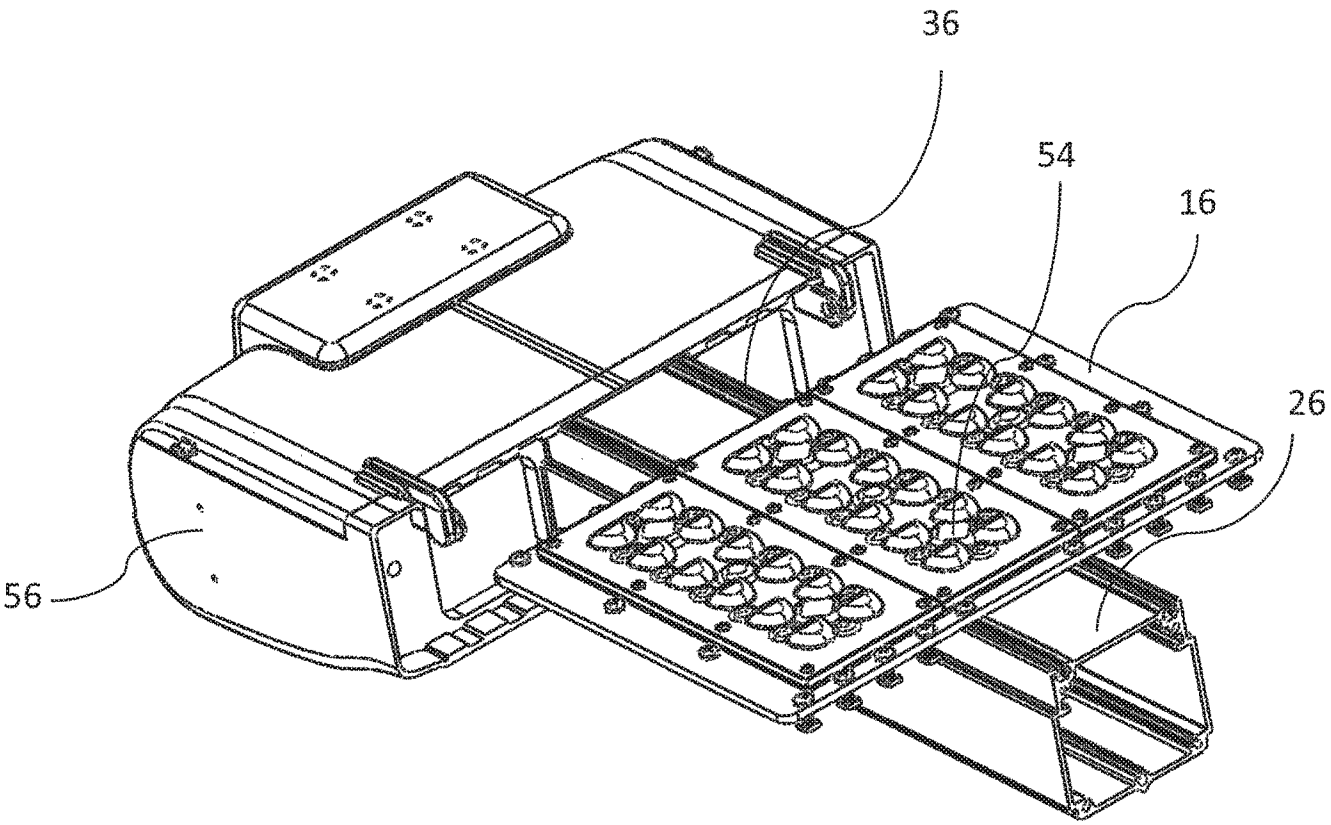
FIG. 25 is an assembly view of the center channel, back enclosure and mounting plate.

Referring to FIG. 22, beginning with the back enclosure 56, screws are placed within holes of the back enclosure 56 and a seal 76 as shown in FIG. 22. Next the center extrusion 26 may be cut to a desired length and the hole 50 may be formed in the center extrusion 28 allowing for passage of the wires 40. A hole may be formed in the center channel 26 for the photo detector if utilized. Holes may be formed in the center extrusion to attach to the mounting plate 16 as shown in FIGS. 23 and 24. Next the mounting plate 16 with the nuts 38 formed thereon are slid and guided into the slots 36 of the center extrusion 26. The holes in the center extrusion 26 are aligned with the nuts 38 and screws are utilized to attached the center extrusion 26 and mounting plate 16, as shown in FIG. 25.

Figure 26:
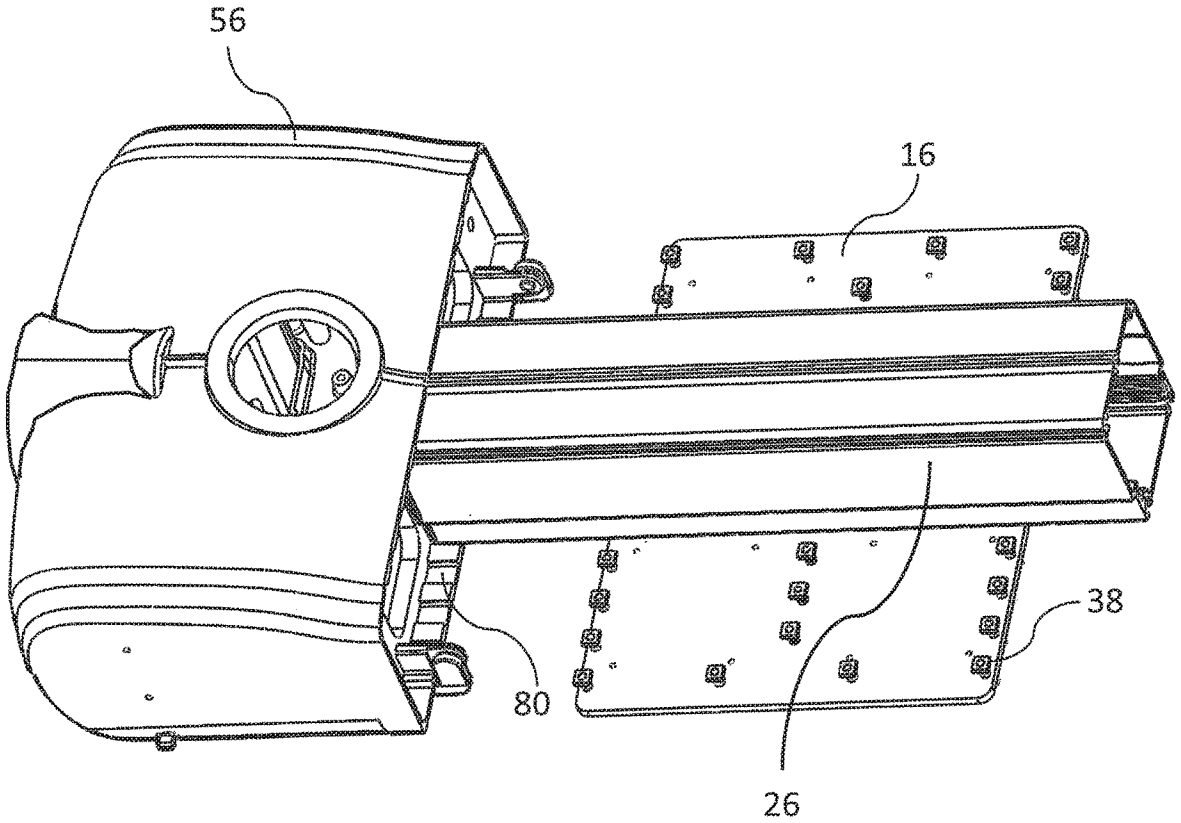
FIG. 26 is an assembly view of the center channel, back enclosure, mounting plate, and extrusions.
Figure 27:
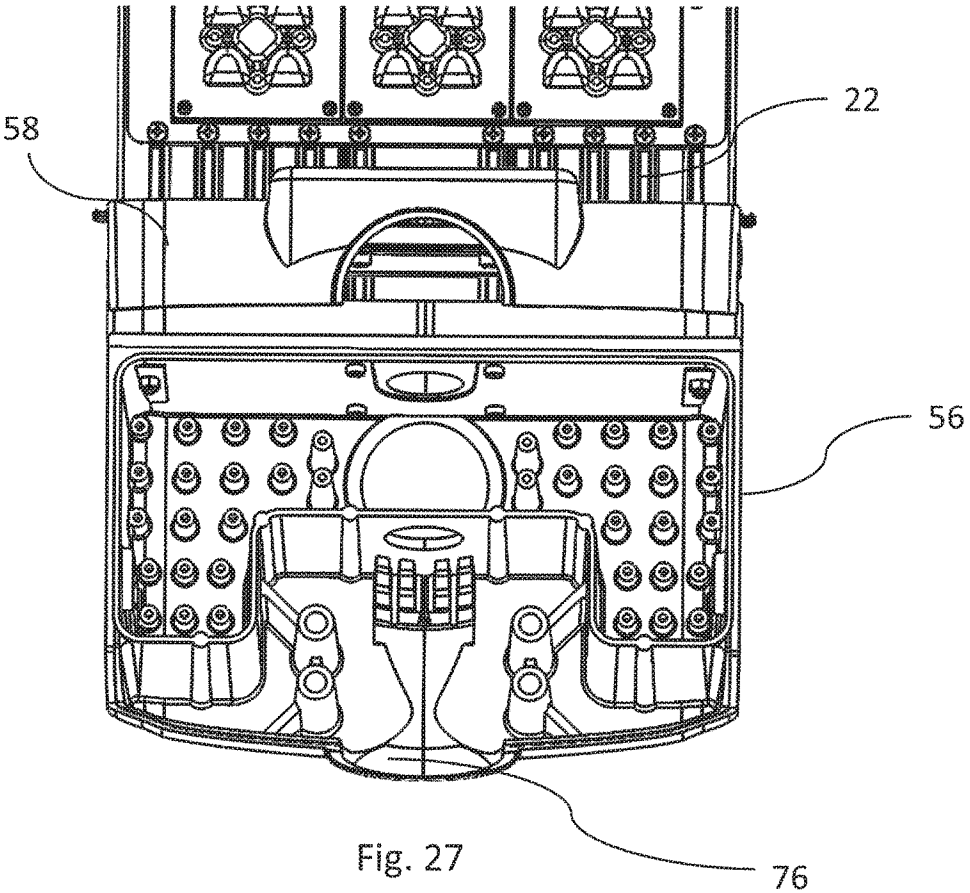
FIG. 27 is an assembly view of the center channel, back enclosure, mounting plate and extrusions and the door containing an integral hinge.

Referring to FIG. 26, next the fin extrusions 22 starting with the ones closest to the center extrusion are positioned within the guides 80 on the back enclosure 56 and the nuts 38 on the mounting plate are received in the slots 36 formed in the fin extrusions 22. Screws may be positioned in the nuts 38 to attached the fin extrusions 22 to the mounting plate 16. After all the fin extrusions have been attached, the hinged door 58 may be attached to the rear enclosure with a gasket as described above and shown in FIG. 27.

Figure 28:
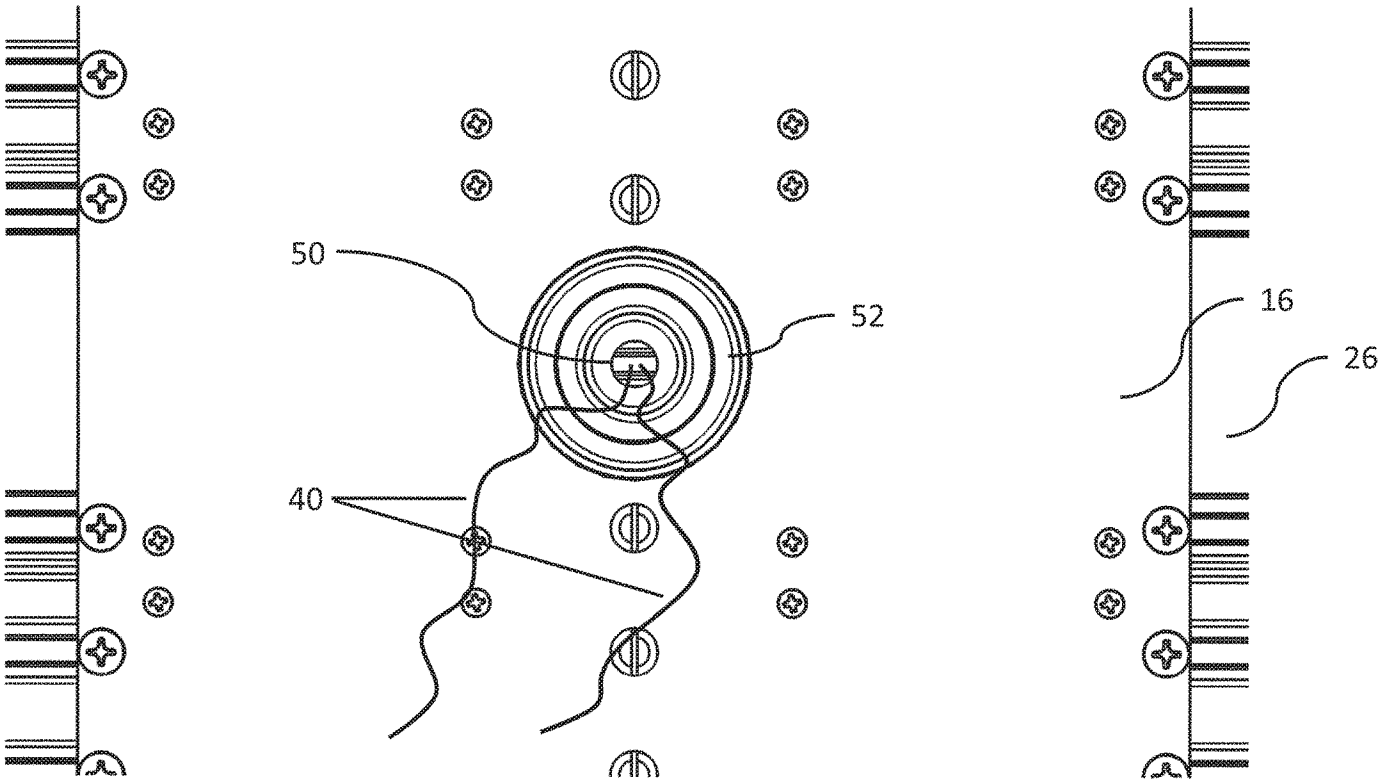
FIG. 28 is an assembly view of the center channel, circuit board wires, and gasket.

Referring to FIG. 28, the gasket may be positioned between the center extrusion and the and the circuit board. The wires 40 from the circuit board are routed through the hole 50 and into the center extrusion 26. The electronic components are connected to the wire and positioned within the center extrusion 26. The cover 54 including the gasket is attached to the circuit board and the circuit board is attached to the mounting plate 16.

Figure 29:
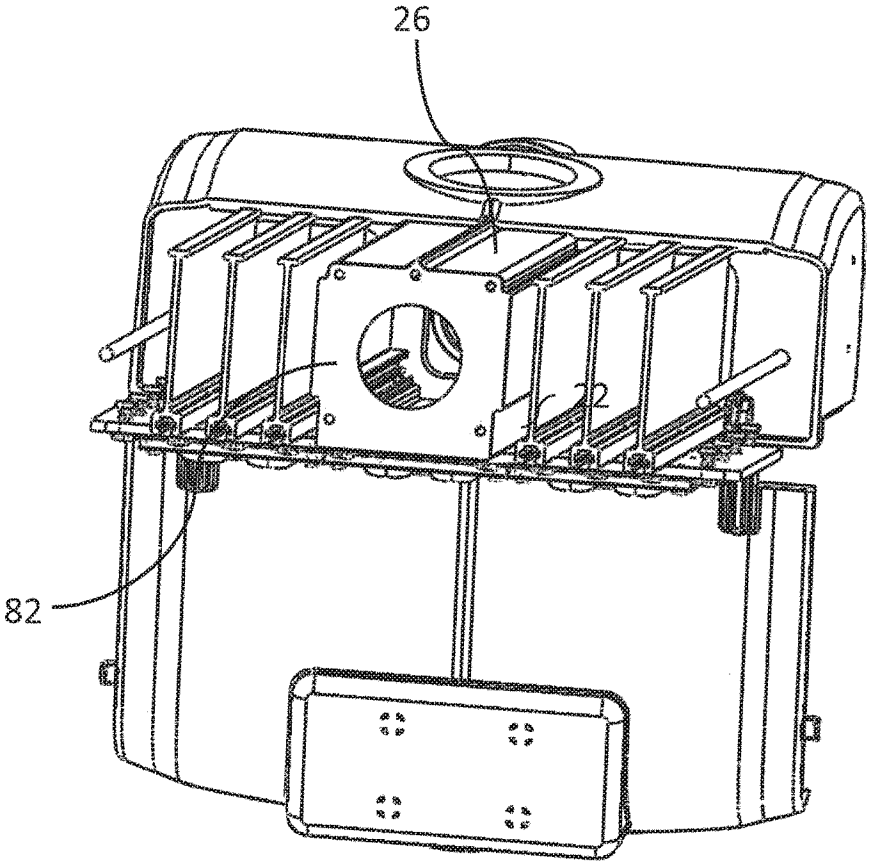
FIG. 29 is an assembly view of the center channel, extrusions, rods, circuit board and center channel front gasket.

Referring to FIG. 29, the front section of the center extrusion may be sealed. A gasket 82 is positioned about the center extrusion 26 as shown. A channel end plate 84 compresses the gasket 82 and seals the end of the center extrusion 26. The channel end plate 84 can be removed and the gasket 82 removed to allow access to the electronics and other objects inside the center channel 26. The front enclosure 68 may be detached from the side rails 20 to assist this operation. The lighting device 10 maintains its structural integrity when the front enclosure 68 is removed since the side rails 20 remain connected to the back enclosure 56 and the led mounting plate 16 remains attached to the side rails 20. This allows the front enclosure 68 to be removed easily and replaced easily to allow easy access to the interior of the center channel 26 such as during maintenance procedures. The rods 64 are cut to length and are threaded into slots in the rear enclosure 56 to support and connect the side rails 20 and rear enclosure 56.

Figure 30:
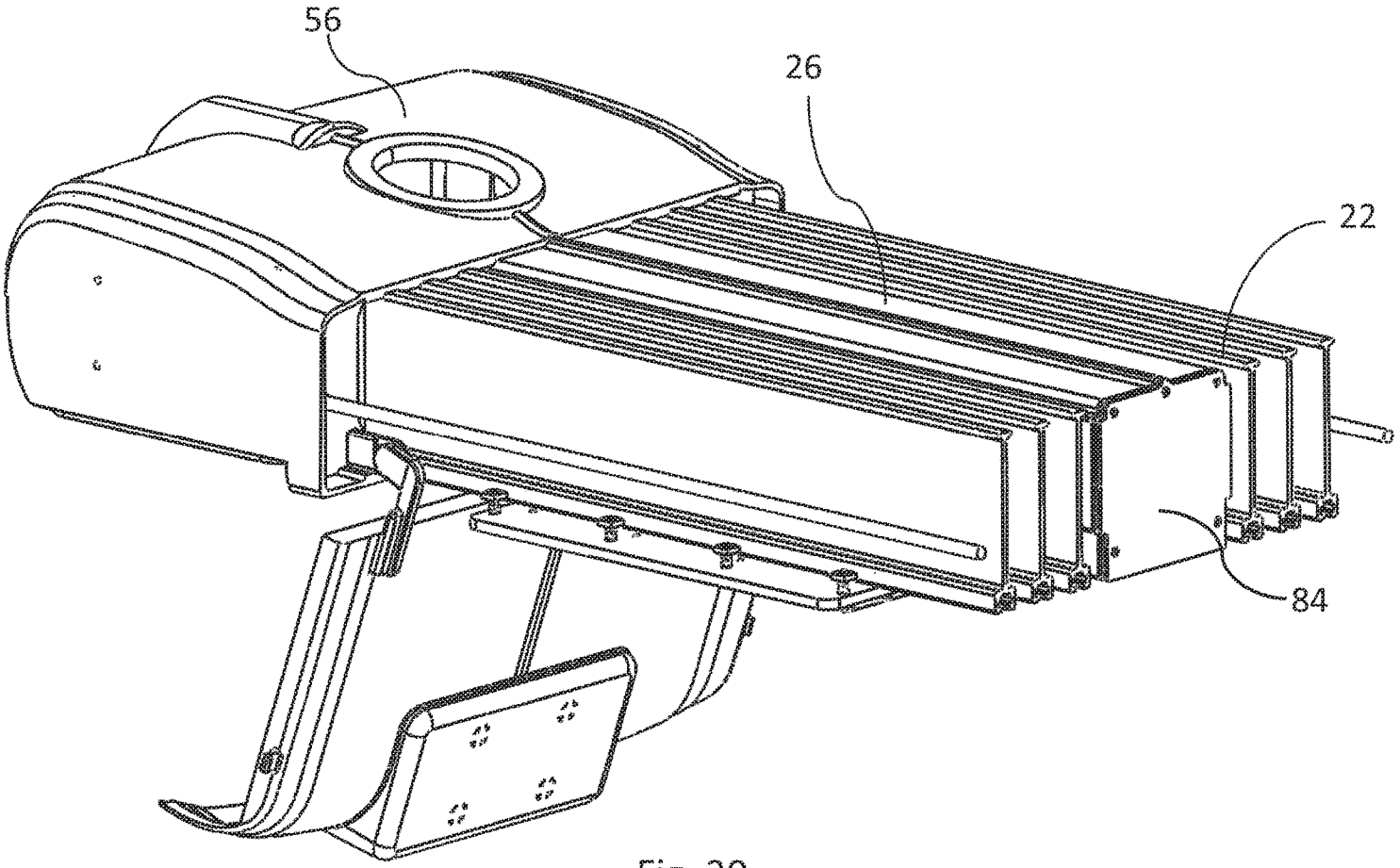
FIG. 30 is an assembly view of the extrusions, and center channel front end plate.

Referring to FIG. 30, an end plate 84 is attached to the center extrusion 26 compressing the gasket 82 and sealing the center extrusion 26.

Figure 31:
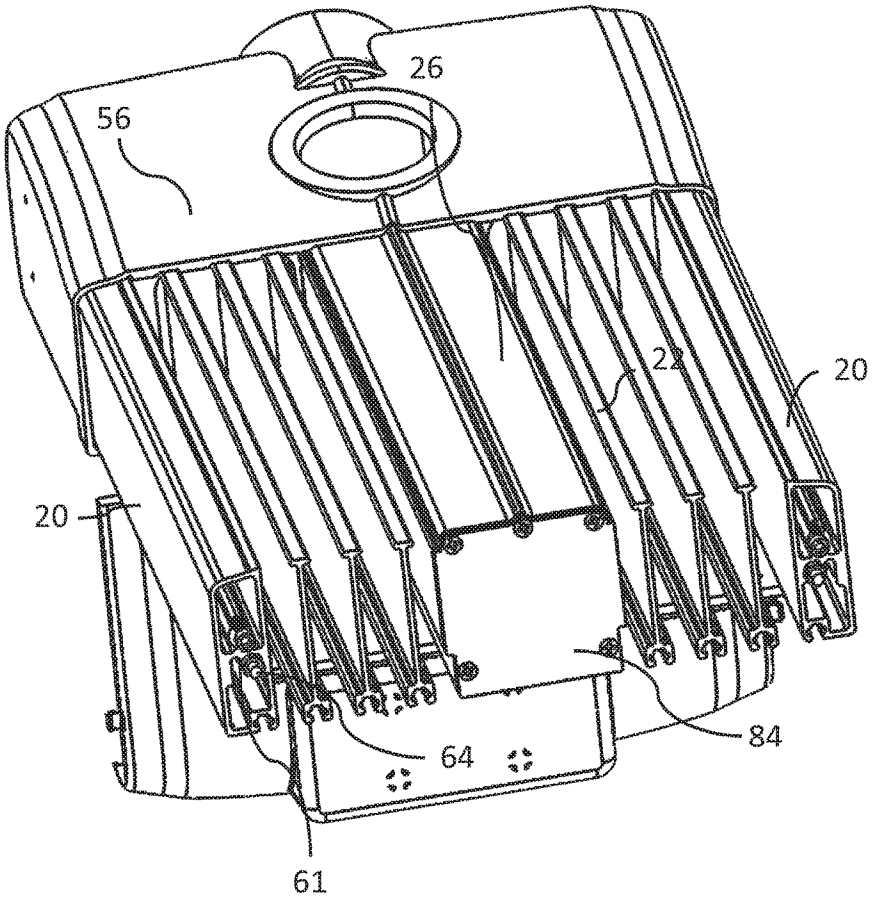
FIG. 31 is an assembly view of the extrusions, front end plate and side rails.

Referring to FIG. 31, the side rails 20 are slid over the rods 64 through the holes 62 in the side rails. The rods 64 are attached to the side rails 20 using nuts 61.

Figure 32:
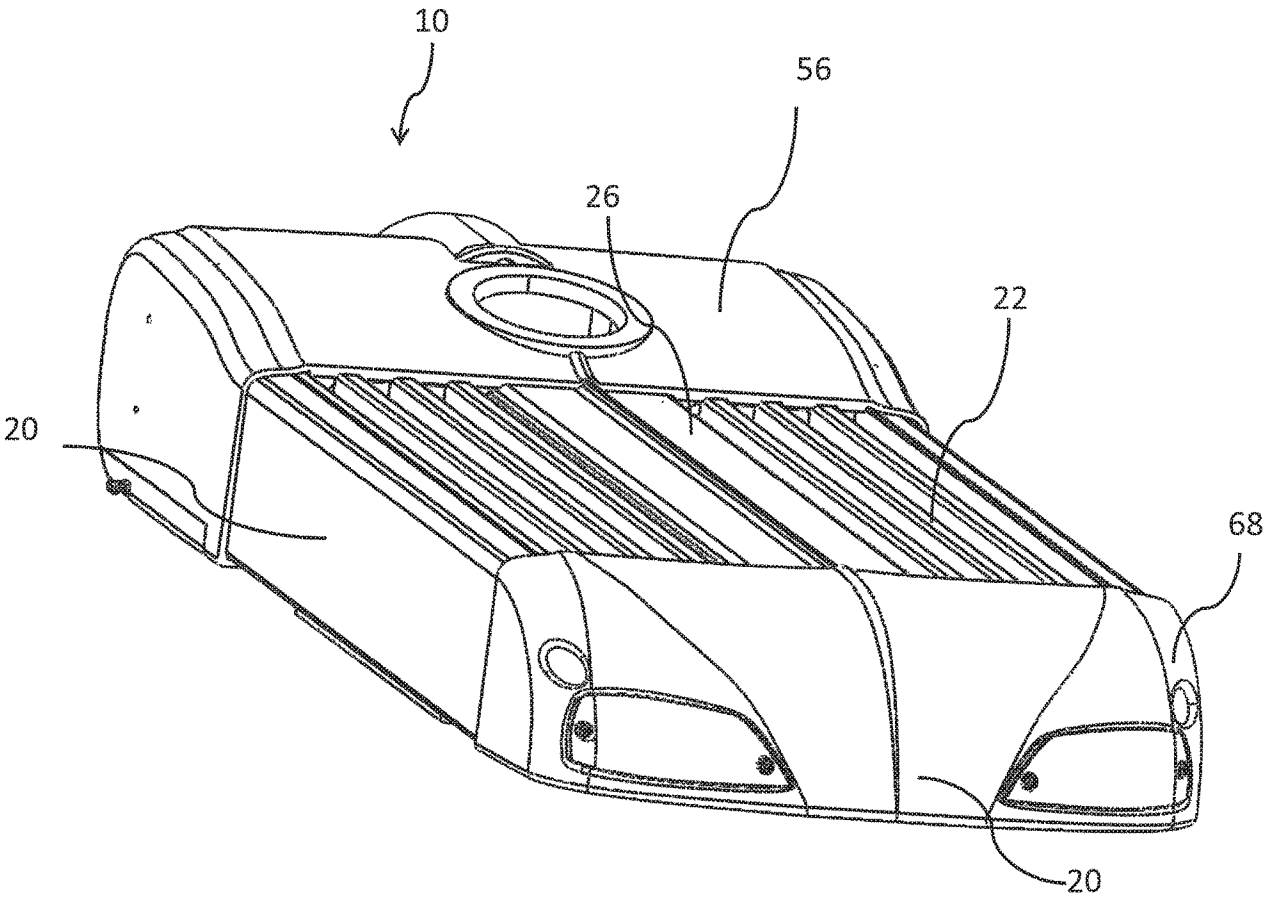
FIG. 32 is the solid state lighting apparatus from the front top perspective view.

Referring to FIG. 32, the front enclosure 68 is now slid over the extrusions 12. Screws may be utilized to a attached the front enclosure to the side rails as described above.

I claim:

1. A lighting apparatus comprising:

a front enclosure;

a back enclosure including guide slots formed thereon;

a center extrusion attached to the back enclosure;

a mounting plate including a plurality of LEDs mounted thereon, the mounting plate attached to the center extrusion;

a circuit board attached to the mounting plate;

a plurality of spaced fin extrusions attached to the mounting plate and positioned in the guide slots of the back enclosure;

side rails attached to the mounting plate and back enclosure and spaced from the fin extrusions; and wherein the plurality of spaced fin extrusions and side rails allow passage of air in an upward direction between the spaced extrusions and side rails transferring heat generated from the lighting apparatus to the air.

2. The lighting apparatus of claim 1 wherein the fin extrusions include an I beam structure wherein a lower portion includes a T shaped slot formed therein slidingly receiving nuts.

3. The lighting apparatus of claim 1 wherein the center extrusion includes a hollow cross section receiving electrical components and sealing said electrical components.

4. The lighting apparatus of claim 1 wherein the center extrusion includes a lower portion having a T shaped slot formed therein slidingly receiving nuts.

5. The lighting apparatus of claim 1 wherein the center extrusion includes a front seal and rear seal preventing entry of water.

6. The lighting apparatus of claim 5 wherein the front seal includes a cover plate attached to the center extrusion compressing a gasket between the cover plate and center extrusion.

7. The lighting apparatus of claim 5 wherein the rear seal includes a gasket compressed between the rear enclosure and the center extrusion.

8. The lighting apparatus of claim 1 wherein the circuit board includes a hole formed therein allowing passage of wires attached to the circuit board and passing through a corresponding hole in the mounting plate.

9. The lighting apparatus of claim 8 wherein the center extrusion includes a wire hole formed therein aligned with the holes in the circuit board and mounting plate, the hole in the center extrusion spaced from the hole in the mounting plate defining a gap.

10. The lighting apparatus of claim 9 including a gasket between the circuit board through the hole in the mounting plate and against the bottom of the center extrusion 26, the gasket compressed between the circuit board and the center extrusion sealing the hole in the circuit board and the hole in the center extrusion.

11. The lighting apparatus of claim 1 including a cover attached to the mounting plate the cover including a gasket sealing the cover relative to the mounting plate.

12. The lighting apparatus of claim 1 wherein the back enclosure includes a top surface, an open bottom and connected side surfaces defining an enclosure for electronic components.

13. The lighting apparatus of claim 12 including a hinged door attached to the back enclosure, the hinged door including a gasket sealing against the rear enclosure.

14. The lighting apparatus of claim 1 wherein the mounting plate includes a plurality of nuts attached thereon and received in T shaped slots formed on the fin extrusions and center extrusion.

15. The lighting apparatus of claim 1 wherein the side rails include two holes formed therein longitudinally along the length of the side rails.

16. The lighting apparatus of claim 15 including rods positioned in the side rails in one of the holes, the rods attached to the back enclosure and to the side rails.

17. The lighting apparatus of claim 15 wherein the other hole includes a threaded bore receiving screws attaching the front enclosure to the side rails.

18. The lighting apparatus of claim 1 wherein the front enclosure includes LEDs positioned therein and positioned in sealed covers allowing flashing signals from a front of the lighting apparatus.

19. A lighting apparatus comprising:

a front enclosure;

a back enclosure;

a mounting plate including a plurality of LEDs mounted thereon, the mounting plate including a plurality of nuts formed thereon;

a circuit board attached to the mounting plate;

a plurality of spaced extrusions attached to the mounting plate, the extrusions including T shaped slots formed thereon slidingly receiving the plurality of nuts of the mounting plate;

wherein the plurality of spaced extrusions allow passage of air in an upward direction between the spaced extrusions transferring heat generated from the lighting apparatus to the air.

* * * * *